US009740125B2

(12) United States Patent
Yamada et al.

(10) Patent No.: US 9,740,125 B2
(45) Date of Patent: Aug. 22, 2017

(54) TONER FOR DEVELOPING ELECTROSTATIC CHARGE IMAGE AND METHOD FOR PREPARING THE SAME

(71) Applicant: SAMSUNG ELECTRONICS CO., LTD., Suwon-si, Gyeonggi-do (KR)

(72) Inventors: Masahide Yamada, Yokohama (JP); Akinori Terada, Yokohama (JP); Keiichi Ishikawa, Yokohama (JP); Kenichi Miyamoto, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/046,822

(22) Filed: Feb. 18, 2016

(65) Prior Publication Data

US 2016/0238958 A1 Aug. 18, 2016

(30) Foreign Application Priority Data

Feb. 18, 2015 (JP) ..... 2015-029545
Apr. 9, 2015 (JP) ..... 2015-080007
Jan. 7, 2016 (KR) ..... 10-2016-0001930

(51) Int. Cl.
*G03G 9/087* (2006.01)
*G03G 9/08* (2006.01)
*G03G 9/093* (2006.01)

(52) U.S. Cl.
CPC ..... *G03G 9/08755* (2013.01); *G03G 9/0804* (2013.01); *G03G 9/0806* (2013.01); *G03G 9/0819* (2013.01); *G03G 9/0821* (2013.01); *G03G 9/08797* (2013.01); *G03G 9/09328* (2013.01)

(58) Field of Classification Search
CPC ..... G03G 9/08755
See application file for complete search history.

(56) References Cited

U.S. PATENT DOCUMENTS 5,346,797 A 9/1994 Kmiecik-Lawrynowicz et al.
2005/0255398 A1 11/2005 Hiraoka et al.
2006/0257777 A1 11/2006 Matsumura et al.
2007/0009823 A1 1/2007 Skorokhod et al.
2007/0092822 A1 4/2007 Matsumura et al.
2007/0196758 A1 8/2007 Sasaki et al.
2009/0123864 A1 5/2009 Sacripante et al.
2010/0047705 A1 2/2010 Sasaki et al.
2010/0178605 A1 7/2010 Koo et al.
2011/0151368 A1 6/2011 Hong et al.
2012/0202149 A1 8/2012 Lee et al.
2012/0214096 A1 8/2012 Pang et al.
2013/0137029 A1 5/2013 Kadonome et al.
2013/0236827 A1* 9/2013 Yoshida ..... G03G 9/08755 430/109.4

FOREIGN PATENT DOCUMENTS

JP S63282752 A 11/1988
JP 06027718 A 2/1994
JP 06250439 A 9/1994
JP 11143118 A 5/1999
JP 2006091124 A 4/2006
JP 2006259460 A 9/2006
JP 2007079205 A 3/2007
JP 3957590 B2 8/2007
JP 2007217249 A 8/2007
JP 2007225838 A 9/2007
JP 2007264142 A 10/2007
JP 2008262149 A 10/2008
JP 2010217588 A 9/2010
JP 2010224461 A 10/2010
JP 2010244033 A 10/2010
JP 2011027791 A 2/2011
JP 2012163623 A 8/2012
JP 2012168222 A 9/2012
JP 2013064819 A 4/2013
JP 2013137508 A 7/2013
JP 2013205609 A 10/2013
JP 2014178626 A 9/2014
KR 1020070044340 A 4/2007
KR 1020100084016 A 7/2010
KR 1020120090597 A 8/2012

OTHER PUBLICATIONS

Extended European Search Report issued on Jun. 8, 2016 in counterpart European Application No. 16155936.4 (5 pages).

* cited by examiner

*Primary Examiner* — Hoa V Le
(74) *Attorney, Agent, or Firm* — NSIP Law

(57) ABSTRACT

A toner for developing an electrostatic charge image, the toner including: elemental iron, wherein a content of the elemental iron is in a range of $1.0\times10^3$ to $1.0\times10^4$ ppm, based on a total weight of the toner; elemental silicon, wherein a content of the elemental silicon is in a range of $1.0\times10^3$ to $5.0\times10^3$ ppm, based on a total weight of the toner; elemental sulfur, wherein a content of the elemental sulfur is in a range of 500 to 3,000 ppm, based on a total weight of the toner; optionally elemental fluorine, wherein a content of the elemental fluorine, if present, is in a range of $1.0\times10^3$ to $1.0\times10^4$ ppm; and a binder resin.

5 Claims, No Drawings

TONER FOR DEVELOPING ELECTROSTATIC CHARGE IMAGE AND METHOD FOR PREPARING THE SAME

CROSS-REFERENCE TO RELATED APPLICATIONS

This application claims priority to and the benefit of Japanese Patent Application No. 2015-029545, filed in the Japanese Intellectual Property Office on Feb. 18, 2015, Japanese Patent Application No. 2015-080007, filed in the Japanese Intellectual Property Office on Apr. 9, 2015, and Korean Patent Application No. 10-2016-0001930, filed in the Korean Intellectual Property Office on Jan. 7, 2016, the entire contents of which are incorporated herein by reference.

BACKGROUND (a) Field

The present disclosure relates to a toner for developing an electrostatic charge image and a method for preparing the same.

(b) Description of the Related Art

Today, a method of visualizing image information via an electrostatic charge image, e.g., an electronic photolithography, has been used in various fields. In the case of the electronic photolithography, the surface of a photoreceptor is uniformly charged, and then an electrostatic charge image is formed on the surface of the photoreceptor. Thereafter, the electrostatic charge image is developed by a developer including a toner to be visualized as a toner image. This toner image is transferred and fixed onto the surface of a recording medium to form a corresponding image. Examples of an employable developer o include a two-component developer, including a toner and a carrier, and a one-component developer exclusively using a magnetic or non-magnetic toner. In views of energy saving, it would be desirable to provide lower-temperature fixing of a toner image in order to reduce power consumption. Accordingly, an improved toner, and method for preparing the same, are needed.

SUMMARY

Disclosed is a toner for developing an electrostatic charge image, the toner including: elemental iron, wherein a content of the elemental iron is in a range of $1.0\times10^3$ to $1.0\times10^4$ ppm, based on a total weight of the toner; elemental silicon, wherein a content of the elemental silicon is in a range of $1.0\times10^3$ to $5.0\times10^3$ ppm, based on a total weight of the toner; elemental sulfur, wherein a content of the elemental sulfur is in a range of 500 to 3,000 ppm, based on a total weight of the toner; optionally elemental fluorine, wherein a content of the elemental fluorine, if present, is in a range of $1.0\times10^3$ to $1.0\times10^4$ ppm; and a binder resin including an amorphous polyester resin, wherein (1) a mole ratio of an aromatic portion of the amorphous polyester resin to an aliphatic portion amorphous polyester resin is in a range of 4.5 to 5.8, (2) a glass transition temperature of the amorphous polyester resin, when measured by a differential scanning calorimetry, is in a range of 50 to 70° C., and (3) an endothermic gradient in the glass transition temperature of the amorphous polyester resin is in a range of 0.1 to 1.0 W/g° C., and a crystalline polyester resin including elemental sulfur and elemental fluorine, wherein (a) an endotherm in the melting of the crystalline polyester resin, when measured by the differential scanning calorimetry, is in a range of 2.0 to 10.0 W/g, (b) a weight average molecular weight of the crystalline polyester resin is in a range of 5,000 to 15,000 Daltons, (c) a difference between an endothermic start temperature and an endothermic peak temperature of the crystalline polyester is in range of 3 to 5° C. when the temperature of the crystalline polyester resin is increased in the differential scanning calorimetry curve when determined by the differential scanning calorimetry, (d) a content of the crystalline polyester resin having a weight average molecular weight of 1,000 Daltons or less which is in a range of 1 to less than 10%, based on a total content of the crystalline polyester resin.

Also disclosed is a method for preparing a toner, which includes a binder resin, for developing an electrostatic charge image, the method including: dehydro-condensing a polycarboxylic acid component and a polyol component in a temperature of 150° C. or less under the presence of a catalyst to provide a condensed amorphous resin; urethane-extending the condensed amorphous resin to synthesize the amorphous polyester resin; forming a latex of the amorphous polyester resin; dehydro-condensing an aliphatic polycarboxylic acid component and an aliphatic polyol component in a temperature of 100° C. or less under the presence of a catalyst to provide a crystalline polyester resin; forming a latex of the crystalline polyester resin; mixing the amorphous polyester resin latex and the crystalline polyester resin latex to form a mixture; adding a flocculant including elemental iron and elemental silicon into the mixture; aggregating the amorphous polyester resin and the crystalline polyester resin to form a primary aggregated particle; disposing a coating layer including the amorphous polyester resin on a surface of the primary aggregated particle to form a coated aggregated particle; and fusing and coalescing the coated aggregated particle in a temperature that is greater than a glass transition temperature of the amorphous polyester resin to form the toner, wherein (1) a mole ratio of an aromatic portion of the amorphous polyester resin to an aliphatic portion of the amorphous polyester resin is in a range of 4.5 to 5.8, (2) a glass transition temperature of the amorphous polyester resin, when measured by a differential scanning calorimetry, is in a range of 50 to 70° C., and (3) an endothermic gradient in the glass transition temperature is in a range of 0.1 to 1.0 W/g° C., and wherein crystalline polyester resin includes elemental sulfur and elemental fluorine, and (a) an endotherm in the melting of the crystalline polyester resin, when measured by the differential scanning calorimetry, is in a range of 2.0 to 10.0 W/g, (b) a weight average molecular weight of the crystalline polyester resin is in a range of 5,000 to 15,000 Daltons, (c) a difference between an endothermic start temperature and an endothermic peak temperature of the crystalline polyester resin is in range of 3 to 5° C. when the temperature of the crystalline polyester resin is increased in the differential scanning calorimetry curve determined by the differential scanning calorimetry, and (d) a content of the crystalline polyester resin having a weight average molecular weight of 1,000 Daltons or less which is in a range of 1 to less than 10%, based on a total content of the crystalline polyester resin, and wherein the catalyst includes elemental sulfur.

DETAILED DESCRIPTION

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

To provide an improved toner which provides lower temperature fixing, a binder resin having a lower glass transition temperature is disclosed in order to provide lower-temperature fixing. Further, a method of kneading and pulverizing of a toner has been employed as a method of preparing a toner. In the method of kneading and pulverizing, a thermoplastic resin is melted and kneaded together with a colorant, such as a pigment, and a releasing agent, such as a wax, and a charge control agent, and is cooled, pulverized, and classified. However, a shape and a surface structure of the toner are indeterminately formed in the kneading and pulverizing. While not wanting to be bound by theory, it is understood that this causes reliability deterioration, such as developer charge degradation, toner scattering, and image deterioration. Therefore, a method of preparing a toner by an emulsion polymerization coagulation method, which can intentionally control the shape and the surface structure, has been suggested. In emulsion polymerization coagulation toner preparation, a resin particulate dispersion liquid is made by emulsion polymerization or the like and a colorant particle dispersion liquid that is obtained by dispersing colorants in a solvent are at least mixed with each other, thereby forming an aggregation having a particle size that corresponds to that of the toner. Thereafter, the aggregation is heated for fusion and unity, to obtain a toner particle having a desired size. As such, according to the toner preparing method, it is easy to reduce a particle size of the toner and it is possible to obtain an improved toner with an improved particle size distribution. In general, a polyester resin having excellent fixedness and preservation has been being employed as a toner binder resin. The polyester resin can be synthesized at a high temperature of 200° C. or more butpolymerization of the polyester resin at a low temperature has recently been being suggested to suppress an energy consumed in the toner preparing operation to reduce environmental load.

As described above, a method of reducing a glass transition temperature of the toner binder resin was suggested to fix the polyester resin in a low temperature. However, when the glass transition temperature of the toner binder resin is reduced, a toner is aggregated inside a printer or during its transport, thereby deteriorating the preservation thereof. Accordingly, a method of accomplishing both of the fixedness and the preservation by dispersing a crystalline resin as another binder resin among main binder resins has been suggested, thereby obtaining a specific effect. However, in the case of keeping the toner in the long term, phase separation of one main binder resin and the crystalline resin occurs, and it is difficult to maintain the low-temperature fixedness when the toner is prepared.

Further, as described above, the polymerization of the polyester resin at a low temperature has recently been being suggested. However, it is difficult to satisfy the low-temperature fixedness and preservation in the polyester resin that is polymerized in a low temperature.

The present invention has been made in an effort to provide a toner for developing an electrostatic charge image and a preparing method thereof, having advantages of being capable of obtaining excellent low-temperature fixedness and preservation and suppressing energy consumption in a toner preparation.

The prevent inventors recognize that a toner having excellent low temperature fixedness and preservation can be obtained by adjusting a mole ratio of an aromatic portion to an aliphatic portion of an amorphous polyester-based resin that is used as a main binder resin, adjusting a glass transition temperature and an endothermic gradient of the glass transition temperature, and adjusting a metal amount of the toner, through repeated researches. Further, the present inventors find that it is possible to maintain the low temperature fixedness at the time of the toner preparation while suppressing the progress of the phase separation by precisely controlling properties of the crystalline polyester resin that is dispersed among the amorphous polyester-based resins.

In addition, when the amorphous polyester-based resin and the crystalline polyester resin used as the binder resin are synthesized, the inventors find that an energy consumption can be significantly reduced by controlling a type and a mixing ratio of a monomer, controlling a type of a catalyst, and suppressing a synthesis temperature to be 150° C. or less.

The present disclosure includes the following configuration.

Configuration 1

A toner for developing an electrostatic charge image, including:

at least a binder resin; and three or more kinds of elements including at least elemental iron, elemental silicon and elemental sulfur from among elemental iron, elemental silicon, elemental sulfur and elemental fluorine, wherein a content of the elemental iron is in a range of $1.0\times10^3$ to $1.0\times10^4$ ppm, a content of the elemental silicon is in a range of $1.0\times10^3$ to $5.0\times10^3$ ppm, and a content of the elemental sulfur is in a range of 500 to 3,000 ppm, in the case of including the elemental fluorine, a content of the elemental fluorine is in a range of $1.0\times10^3$ to $1.0\times10^4$ ppm, and the binder resin comprises at least an amorphous polyester-based resin and a crystalline polyester resin, wherein the amorphous polyester-based resin include:

(1) a mole ratio of an aromatic portion to an aliphatic portion, which is in a range of 4.5 to 5.8, (2) a glass transition temperature measured by a differential scanning calorimetry which is in a range of 50 to 70° C., and (3) an endothermic gradient in the glass transition temperature which is in a range of 0.1 to 1.0 W/g·° C., and the crystalline polyester resin includes:

(a) an endothermic amount in the melting by the differential scanning calorimetry, which is in a range of 2.0 to 10.0 W/g, (b) a weight average molecular weight, which is in a range of 5,000 to 15,000 Daltons, (c) a difference between an endothermic start temperature and an endothermic peak temperature which is in range of 3 to 5° C. when the temperature of the crystalline polyester resin is increased in the differential scanning calorimetry curve determined by the differential scanning calorimetry, (d) one or more kinds of elements including at least elemental sulfur from among the elemental sulfur and the elemental fluorine, and (e) a content rate of the weight average molecular weight of 1,000 Daltons or less which is in a range of 1 to less than 10%.

Configuration 2

The toner of Configuration 1 may further include a coating layer disposed on an external surface, and the coating layer may be formed of at least the amorphous polyester-based resin.

Configuration 3

In the toner of Configuration 1 or 2, a thickness of the coating layer may be in a range of 0.2 to 1.0 μm.

Configuration 4

The toner of one of Configurations 1 to 3 may have an acid value that is in a range of 3 to 25 mg KOH/g.

Configuration 5

In the toner of one of Configurations 1 to 4, a volume average particle diameter may be in a range of 3 to 9 μm, a number average particle size of 3 μm or less may be equal to or smaller than 3% by number, the number average particle size of 3 μm or less to number average particle size of 1 μm or less may be in a range of 2.0 to 4.0.

Configuration 6

A method for preparing a toner, including at least a binder resin, for developing an electrostatic charge image, including:

an amorphous polyester-based resin synthesizing process for dehydro-condensing a polycarboxylic acid component and a polyol component in a temperature of 150° C. or less under the presence of a catalyst, urethane-extending a thus-obtained resin, and synthesizing the amorphous polyester-based resin;

an amorphous polyester-based resin latex forming process for forming a latex of the amorphous polyester-based resin;

a crystalline polyester resin synthesizing process for synthersizing a crystalline polyester resin by dehydro-condensing an aliphatic polycarboxylic acid component and an aliphatic polyol component in a temperature of 100° C. or less under the presence of a catalyst;

a crystalline polyester resin latex forming process for forming a latex of the crystalline polyester resin;

a mixed solution forming process for forming a mixed solution by mixing at least the amorphous polyester-based resin latex and the crystalline polyester resin latex;

a primary aggregated particle forming process for adding a flocculant into the mixed solution, and forming a primary aggregated particle by aggregating the amorphous polyester-based resin and the crystalline polyester resin;

a coated aggregated particle forming process for forming a coated aggregated particle by disposing a coating layer formed of the amorphous polyester-based resin on a surface of the primary aggregated particle; and a fusing and coalescing process for fusing and coalescing the coated aggregated particle in a temperature that is higher than a glass transition temperature of the amorphous polyester-based resin, wherein the amorphous polyester-based resin include:

(1) a mole ratio of an aromatic portion to an aliphatic portion, which is in a range of 4.5 to 5.8, (2) a glass transition temperature measured by a differential scanning calorimetry which is in a range of 50 to 70° C., and (3) an endothermic gradient in the glass transition temperature which is in a range of 0.1 to 1.0 W/g·° C., the crystalline polyester resin includes:

(a) an endothermic amount in the melting by the differential scanning calorimetry, which is in a range of 2.0 to 10.0 W/g, (b) a weight average molecular weight, which is in a range of 5,000 to 15,000 Daltons, (c) a difference between an endothermic start temperature and an endothermic peak temperature which is in range of 3 to 5° C. when the temperature of the crystalline polyester resin is increased in the differential scanning calorimetry curve determined by the differential scanning calorimetry, (d) one or more kinds of elements including at least elemental sulfur from among the elemental sulfur and the elemental fluorine, and (e) a content rate of the weight average molecular weight of 1,000 Daltons or less which is in a range of 1 to less than 10%, the catalyst includes one or more kinds of elements including at least elemental sulfur from among the elemental sulfur and the elemental fluorine, and the flocculant includes elemental iron and elemental silicon.

As described above, depending on the toner for developing an electrostatic charge image according to an exemplary embodiment, three or more kinds of elements including at least elemental iron, elemental silicon and elemental sulfur from among elemental iron, elemental silicon, elemental sulfur and elemental fluorine may be included, a content of the elemental iron may be in a range of 1.0×103 to 1.0×104 ppm, a content of the elemental silicon may be in a range of 1.0×103 to 5.0×103 ppm, and a content of the elemental sulfur may be in a range of 500 to 3,000 ppm, and, in the case of including the elemental fluorine, a content of the elemental fluorine may be in a range of 1.0×103 to 1.0×104 ppm.

Further, the binder resin may include at least an amorphous polyester-based resin and a crystalline polyester resin. The amorphous polyester-based resin may have: (1) a mole ratio of an aromatic portion to an aliphatic portion which is in a range of 4.5 to 5.8, (2) a glass transition temperature measured by a differential scanning calorimetry which is in a range of 50 to 70° C., and (3) an endothermic gradient in the glass transition temperature which is in a range of 0.1 to 1.0 W/g·° C. The crystalline polyester resin have: (a) an endothermic amount in the melting by the differential scanning calorimetry which is in a range of 2.0 to 10.0 W/g, (b) a weight average molecular weight which is in a range of 5,000 to 15,000 Daltons, (c) a difference between an endothermic start temperature and an endothermic peak temperature which is in range of 3 to 5° C. when the temperature of the crystalline polyester resin is increased in the differential scanning calorimetry curve determined by the differential scanning calorimetry, (d) one or more kinds of elements including at least elemental sulfur from among the elemental sulfur and the elemental fluorine, and (e) a content rate of the weight average molecular weight of 1,000 Daltons or less which is in a range of 1 to less than 10%. Accordingly, it is possible to obtain a toner for developing an electrostatic charge image capable of obtaining excellent low-temperature fixedness and preservation and suppressing energy consumption in a toner preparation.

According to an exemplary embodiment of the present exemplary embodiment, the method for preparing a toner for developing an electrostatic charge image may include an amorphous polyester-based resin synthesizing process for dehydro-condensing a polycarboxylic acid component and a polyol component in a temperature of 150° C. or less under the presence of a catalyst, urethane-extending a thus-obtained resin, and synthesizing the amorphous polyester-based resin; an amorphous polyester-based resin latex forming process for forming a latex of the amorphous polyester-based resin; a crystalline polyester resin synthesizing process for synthesizing a crystalline polyester resin by dehydro-condensing an aliphatic polycarboxylic acid component and an aliphatic polyol component in a temperature of 100° C. or less under the presence of a catalyst; a crystalline polyester resin latex forming process for forming a latex of the crystalline polyester resin; a mixed solution forming process for forming a mixed solution by mixing at least the amorphous polyester-based resin latex and the crystalline polyester resin latex; a primary aggregated particle forming process for adding a flocculant into the mixed solution, and forming a primary aggregated particle by aggregating the amorphous polyester-based resin and the crystalline polyester resin; a coated aggregated particle forming process for forming a coated aggregated particle by disposing a coating layer formed of the amorphous polyester-based resin on a surface of the primary aggregated particle; and a fusing and coalescing process for fusing and coalescing the coated aggregated particle in a temperature that is higher than a glass transition temperature of the amorphous polyester-based resin. Herein, the amorphous polyester-based resin may have: (1) a mole ratio of an aromatic portion to an aliphatic portion which is in a range of 4.5 to 5.8, (2) a glass transition temperature measured by a differential scanning calorimetry which is in a range of 50 to 70° C., and (3) an endothermic gradient in the glass transition temperature which is in a range of 0.1 to 1.0 W/g·° C. The crystalline polyester resin have: (a) an endothermic amount in the melting by the differential scanning calorimetry which is in a range of 2.0 to 10.0 W/g, (b) a weight average molecular weight which is in a range of 5,000 to 15,000 Daltons, (c) a difference between an endothermic start temperature and an endothermic peak temperature which is in range of 3 to 5° C. when the temperature of the crystalline polyester resin is increased in the differential scanning calorimetry curve determined by the differential scanning calorimetry, (d) one or more kinds of elements including at least elemental sulfur from among the elemental sulfur and the elemental fluorine, and (e) a content rate of the weight average molecular weight of 1,000 Daltons or less which is in a range of 1 to less than 10%. The catalyst may include one or more kinds of elements including at least elemental sulfur from among the elemental sulfur and the elemental fluorine. The flocculant may include elemental iron and elemental silicon. Accordingly, it is possible to prepare a toner for developing an electrostatic charge image capable of obtaining excellent low-temperature fixedness and preservation and suppressing energy consumption in a toner preparation.

Hereinafter, exemplary embodiments will be further described in detail. The exemplary embodiments serve as examples without being limited to the scope of the present disclosure.

A. Toner for Developing an Electrostatic Charge Image

According to an exemplary embodiment, the toner for developing the electrostatic charge image includes a binder resin. The binder resin comprises two kinds or more of polyester resins. One of the two kinds or more of polyester resins is an amorphous polyester-based resin, which will be described below, and another is a crystalline polyester resin, which will be described below.

The amorphous polyester-based resin, which can be used as the binder resin, include following characteristics (1) to (3).

(1) A mole ratio of an aromatic portion to an aliphatic portion is in a range of 4.5 to 5.8.

(2) A glass transition temperature measured by a differential scanning calorimetry is in a range of 50 to 70° C.

(3) An endothermic gradient in the glass transition temperature is in a range of 0.1 to 1.0 W/g·° C.

The characteristic (1) of the amorphous polyester-based resin can be controlled by adjusting a type, a mixing ratio, and/or the like of a polyol component and a polycarboxylic acid component used as a monomer of the amorphous polyester-based resin, and by adjusting a type, an amount, or the like of a polyisocyanate component Herein, the aromatic portion is derived from a monomer having an aromatic ring, and the aliphatic portion is derived from a monomer having no ring. In other words, the characteristic (1) of the amorphous polyester-based resin corresponds to a mole ratio of the monomer having the aromatic ring to the monomer having no ring.

As described above, the mole ratio of the aromatic portion to the aliphatic portion of the amorphous polyester-based resin is in the range of 4.5 to 5.8. For example, the mole ratio may be in a range of 4.5 to 5.5. The amorphous polyester-based resin having the mole ratio of the aromatic portion to the aliphatic portion, which is in the range of 4.5 to 5.8, may be synthesized in a low temperature. If the mole ratio of the aromatic portion to the aliphatic portion exceeds 5.8, the properties of the resin are excessively increased. If the mole ratio of the aromatic portion to the aliphatic portion is smaller than 4.5, the properties of the resin are excessively reduced.

As will be described later, the mole ratio of the aromatic portion to the aliphatic portion of the amorphous polyester-based resin may be calculated by analyzing ultraviolet absorption spectrums The characteristic (2) of the amorphous polyester-based resin may be controlled by adjusting the type, the mixing ratio, or the like of the polyol component and the polycarboxylic acid component used as the monomer of the amorphous polyester-based resin.

As described above, the glass transition temperature of the amorphous polyester-based resin is in the range of 50 to 70° C. For example, the glass transition temperature may be in a range of 55 to 65° C. When the glass transition temperature is in the range of 50 to 70° C., it is possible to obtain the toner for developing an electrostatic charge image, which has excellent low temperature fixedness and preservation. If the glass transition temperature exceeds 70° C., the low temperature fixedness may be deteriorated. If the glass transition temperature is lower than 50° C., the preservation may be deteriorated.

As will be described later, the glass transition temperature of the amorphous polyester-based resin may be calculated from a differential scanning calorimetry curve that is obtained by measurement of a differential scanning calorimeter.

The characteristic (3) of the amorphous polyester-based resin may be controlled by adjusting the type, the mixing ratio, or the like of the polyol component and the polycarboxylic acid component used as the monomer of the amorphous polyester-based resin.

As described above, the endothermic gradient in the glass transition temperature of the amorphous polyester-based resin is in the range of 0.1 to 1.0 W/g·° C. For example, the endothermic gradient is in a range of 0.2 to 1.0 W/g·° C. If the endothermic gradient in the glass transition temperature is in the range of 01. to 1.0 W/g·° C., it is possible to obtain the toner for developing an electrostatic charge image, which has excellent low temperature fixedness and preservation. If the endothermic gradient in the glass transition temperature exceeds 1.0 W/g·° C., an electrical characteristic of the toner may be deteriorated. If the endothermic gradient in the glass transition temperature is less than 0.1 W/g·° C., the low temperature fixedness may be deteriorated.

As will be described later, the endothermic gradient in the glass transition temperature of the amorphous polyester-based resin may be calculated from a differential scanning calorimetry curve that is obtained by measurement of a differential scanning calorimeter.

A weight average molecular weight of the amorphous polyester-based resin may be in a range of 5,000 to 50,000 Daltons. For example, the weight average molecular weight of the amorphous polyester-based resin may be in a range of 10,000 to 40,000 Daltons. When the weight average molecular weight is in the range of 5,000 to 50,000 Daltons, it is possible to obtain good fixedness, toner durability in a developer, and image durability. If the weight average molecular weight exceeds 50,000 Daltons, the heat characteristic may be excessively increased. If the weight average molecular weight is smaller than 5,000 Daltons, printed image durability may be deteriorated. The weight average molecular weight of the amorphous polyester-based resin may be controlled by adjusting a reaction temperature, time, and the like in the toner preparation.

As will be described later, the weight average molecular weight of the amorphous polyester-based resin may be measured by using a gel permeation chromatography (GPC).

The amorphous polyester-based resin is synthesized by dehydro-condensing the polycarboxylic acid component and the polyol component and urethane-extending a thus-obtained resin. As the polycarboxylic acid component which can be used in synthesize the amorphous polyester-based resin, it may be mentioned common organic polycarboxylic acids. Detailed examples of the organic polycarboxylic acid may include maleic anhydride, phthalic anhydride, and succinic acid.

Detailed examples of the polyol component which can be used to synthesize the amorphous polyester-based resin may include an ethylene oxide 2 mol adduct or a propylene oxide 2 mol adduct of bisphenol A, but are not limited thereto.

A general polyisocyanate compound may be employed as the polyisocyanate component for urethane-extending, which can be used to form the amorphous polyester-based resin. Detailed examples of the polyisocyanate component may include diphenylmethane diisocyanate, toluene diisocyanate, Isophoronediisocyanate, hexamethylenediisocyanate, and norbornene diisocyanate, and an isocyanurate compound and adducts of this diisocyanate compound.

A catalyst, which can be used to synthesize the amorphous polyester-based resin, may include one or more kinds of elements including at least elemental sulfur from among elemental sulfur and elemental fluorine. Detailed examples of this catalyst may include paratoluene sulfonic acid.1hydrate, bis(1,1,2,2,3,3,4,4,4-nonafluoro-1-butan sulfonyl)imide, and scandium(III)triflate, etc. As such, by using this catalyst, it is possible to synthesize the amorphous polyester-based resin in a temperature of 150° C. or less.

The crystalline polyester resin that can be used as the binder resin include following characteristics (a) to (e).

(a) An endothermic amount in the melting measured by the differential scanning calorimetry is in a range of 2.0 to 10.0 W/g.

(b) The weight average molecular weight is in a range of 5,000 to 15,000 Daltons.

(c) A difference between an endothermic start temperature and an endothermic peak temperature is in range of 3 to 5° C. when the temperature of the crystalline polyester resin is increased in the differential scanning calorimetry curve determined by the differential scanning calorimetry.

(d) One or more kinds of elements including at least elemental sulfur from among the elemental sulfur and the elemental fluorine are included.

(e) The content rate of the weight average molecular weight of 1,000 Daltons or less is in a range of 1 to less than 10%.

As described above, the endothermic amount in the melting of the crystalline polyester resin is in the range of 2.0 to 10.0 W/g. For example, the endothermic amount is in a range of 3.0 to 9.0 W/g. When the endothermic amount in the melting is in the range of 2.0 to 10.0 W/g, the melting of the toner for developing the electrostatic charge image may be promoted by small quantity of heat. If the endothermic amount in the melting exceeds 10 W/g, large quantity of heat may be required to melt the crystalline polyester resin. If the endothermic amount in the melting is smaller than 2.0 W/g, the crystallinity of the crystalline polyester resin may be reduced.

As described above, the weight average molecular weight of the crystalline polyester resin may be in the range of 5,000 to 15,000 Daltons. If the weight average molecular weight is smaller than 5,000 Daltons, the compatibilization of the crystalline polyester resin and the amorphous polyester-based resin may occur each other, thereby lead to deteriorate toner preservation. If the weight average molecular weight exceeds 15,000, the low temperature fixedness of the toner may be deteriorated.

When the temperature of the crystalline polyester resin is increased, the difference between the endothermic start temperature and the endothermic peak temperature is in range of 3 to 5° C. If the difference between the endothermic start temperature and the endothermic peak temperature is lower than 3° C. when the temperature is increased, it is difficult to synthesize the crystalline polyester resin while securing preparability of the toner. If the difference between the endothermic start temperature and the endothermic peak temperature exceeds 3° C. when the temperature is increased, the toner preservation may be deteriorated and it may be difficult to maintain fixing performance after the long-term preservation of the toner.

The crystalline polyester resin includes one or more kinds of elements including at least elemental sulfur from among elemental sulfur and elemental fluorine as an element derived from a catalyst for performing the synthesizing in a temperature of 100° C. or less.

In the crystalline polyester resin, the content rate of the weight average molecular weight of 1,000 Daltons or less is in a range of 1 to less than 10%. If the content rate of the weight average molecular weight of 1,000 Daltons or less is equal to or greater than 10%, this may cause toner heat preservation to be deteriorated and toner fixing lower limit performance to be deteriorated after the toner heat storage. If the content rate of the weight average molecular weight of 1,000 Daltons or less is smaller than 1%, the toner fixing lower limit performance may be deteriorated.

The endothermic amount when the crystalline polyester resin is melted and the difference between the endothermic start temperature and the endothermic peak temperature when the temperature of the crystalline polyester resin is increased may be controlled by adjusting a type, a mixing ratio, or the like of the polyol component and the polycarboxylic acid component used as the monomer of the crystalline polyester resin. Further, the weight average molecular weight of the crystalline polyester resin and the content rate of the weight average molecular weight of 1,000 Daltons or less may be controlled by adjusting a reaction temperature, time, and the like in the toner preparation.

As will be described later, the endothermic amount when the crystalline polyester resin is melted and the difference between the endothermic start temperature and the endothermic peak temperature when the temperature of the crystalline polyester resin is increased may be calculated from the differential scanning calorimetry curve that is measured by using the differential scanning calorimeter. Further, as will be described later, the weight average molecular weight of the crystalline polyester resin and the content rate of the weight average molecular weight of 1,000 Daltons or less may be measured by using a gel permeation chromatography (GPC). In addition, as will be described later, a content of elemental sulfur and elemental fluorine in the crystalline polyester resin may be measured by a X-ray fluorescence analysis.

A melting point of the crystalline polyester resin is in a range of 60 to 80° C. For example, the melting point is in a range of 65 to 75° C. When the melting point is in the range of 60 to 80° C., it is possible to accomplish both of the toner fixedness and the preservation. If the melting point exceeds 80° C., the toner fixedness may be deteriorated. If the melting point is lower than 60° C., the preservation may be deteriorated.

The melting point of the crystalline polyester resin may be controlled by adjusting a type, a mixing ratio, or the like of the polyol component and the polycarboxylic acid component used as the monomer of the crystalline polyester resin.

As will be described later, the melting point of the crystalline polyester resin may be calculated from a differential scanning calorimetry curve that is obtained by measurement of a differential scanning calorimeter.

A content of the crystalline polyester resin may be in a range of 5 to 20 wt % for the entire binder resin. For example, the content is in a range of 7 to 15 wt %. When the content of the crystalline polyester resin is in the range of 5 to 20 wt %, it is possible to accomplish both of the toner fixedness and the preservation. If the content of the crystalline polyester resin exceeds 20 wt %, the preservation and the electrical characteristic may be deteriorated. If the content of the crystalline polyester resin is smaller than 5 wt %, the fixedness may be deteriorated.

The crystalline polyester resin is synthesized by dehydrocondensing the polycarboxylic acid component and the polyol component.

An aliphatic polycarboxylic acid may be employed as the polycarboxylic acid component, which can be used to synthesize the crystalline polyester resin. Detailed examples of the polycarboxylic acid component may include an adipic acid, a suberic acid, a decanedioic acid, and a dodecanedioic acid.

Aliphatic polyol may be employed as the polyol component, which can be used to synthesize the crystalline polyester resin. Detailed examples of the polyol component may include 1,6-hexanediol, 1,8-octanediol, 1,9-nonanediol, and 1,10-decanediol.

A catalyst, which can be used to synthesize the crystalline polyester resin, may include one or more kinds of elements including at least elemental sulfur from among elemental sulfur and elemental fluorine. Detailed examples of this catalyst may include paratoluene sulfonic acid.1hydrate, dodecyl benzene sulfonic acid, bis(1,1,2,2,3,3,4,4,4-nonafluoro-1-butan sulfonyl)imide, and scandium(III)triflate. As such, by using this catalyst, it is possible to synthesize the crystalline polyester resin in a temperature of 100° C. or less.

In the present exemplary embodiment, the toner for developing an electrostatic charge image includes a coating layer that is formed on an external surface thereof by using a binder resin. The coating layer is formed of an amorphous polyester-based resin having aforementioned characteristics 1 to 3.

A thickness of the coating layer may be in a range of 0.2 to 1.0 μm. If the thickness is smaller than 0.2 μm, this may cause toner heat preservation to be deteriorated. If the thickness exceeds 1.0 μm, this may cause toner fixing lower limit performance to be deteriorated.

The thickness of the coating layer may be measured by using a transmission electron microscope.

In the toner for developing an electrostatic charge image according to the present exemplary embodiment, a polyester resin that is different from the amorphous polyester-based resin and the crystalline polyester resin described above may be employed as the binder resin.

In the present exemplary embodiment, the toner for developing an electrostatic charge image includes three or more kinds of elements including at least elemental iron, elemental silicon and elemental sulfur from among elemental iron, elemental silicon, elemental sulfur and elemental fluorine. A content of the elemental iron is in a range of $1.0\times10^3$ to $1.0\times10^4$ ppm, a content of the elemental silicon is in a range of $1.0\times10^3$ to $5.0\times10^3$ ppm, and a content of the elemental sulfur is in a range of 500 to 3,000 ppm. In the case of including the elemental fluorine, a content of the elemental fluorine is in a range of $1.0\times10^3$ to $1.0\times10^4$ ppm.

The elemental iron and the elemental silicon are components derived from flocculant that will be described later, the elemental sulfur is a component derived from catalyst and flocculant that will be described later, and the elemental fluorine is a component derived from catalyst that will be described later. Accordingly, the contents of the elemental iron and the elemental silicon included in the toner for developing an electrostatic charge image may be controlled by adjusting a type, an amount, and the like of the employed flocculant, the content of the elemental sulfur may be controlled by adjusting a type, an amount, and the like of the catalyst and the flocculant which are employed, and the content of the elemental fluorine may be controlled by adjusting a type, an amount, and the like of the employed catalyst.

As described above, the content of the elemental iron included in the toner for developing an electrostatic charge image is in the range of $1.0\times10^3$ to $1.0\times10^4$ ppm. For example, the content of the elemental iron may be in a range of 1,000 to 5,000 ppm. When the content of the elemental iron is in the range of $1.0\times10^3$ to $1.0\times10^4$ ppm, the toner may be used as the toner for developing an electrostatic charge image. If the content of the elemental iron exceeds $1.0\times10^4$ ppm, the toner property may be excessively increased. If the content of the elemental iron is smaller than $1.0\times10^3$ ppm, the toner structure is insufficiently formed.

As described above, the content of the elemental silicon included in the toner for developing an electrostatic charge image is in the range of $1.0\times10^3$ to $5.0\times10^3$ ppm.

For example, the content of the elemental silicon may be in a range of 1,500 to 4,000 ppm. When the content of the elemental silicon is in the range of $1.0\times10^3$ to $5.0\times10^3$ ppm, the toner may be used as the toner for developing an electrostatic charge image. If the content of the elemental silicon exceeds $5.0\times10^3$ ppm, the toner property may be excessively increased. If the content of the elemental silicon is smaller than $1.0\times10^3$ ppm, the toner structure is insufficiently formed.

As described above, the content of the elemental sulfur included in the toner for developing an electrostatic charge image is in the range of 500 to 3,000 ppm. For example, the content of the elemental sulfur may be in a range of 1,000 to 3,000 ppm. When the content of the elemental sulfur is in the range of 500 to 3,000 ppm, the toner may be used as the toner for developing an electrostatic charge image. If the content of the elemental sulfur exceeds 3,000 ppm, the toner electrical characteristic may be deteriorated. If the content of the elemental sulfur is smaller than 500 ppm, the toner structure is insufficiently formed. When the toner for developing an electrostatic charge image includes the elemental fluorine, the content of the elemental fluorine included therein is in the range of $1.0\times10^3$ to $1.0\times10^4$ ppm. For example, the content of the elemental fluorine may be in a range of 5,000 to 8,000 ppm. If the content of the elemental fluorine is $1.0\times10^3$-$1.0\times10^4$ ppm, the toner may be used as the toner for developing an electrostatic charge image. If the content of the elemental fluorine exceeds $1.0\times10^4$ ppm, the toner property may be excessively increased. If the content of the elemental fluorine is smaller than $1.0\times10^3$ ppm, the toner property may be deteriorated.

As will be described later, the content of each element included in the toner for developing an electrostatic charge image may be measured by a X-ray fluorescence analysis.

In the present exemplary embodiment, the toner for developing an electrostatic charge image may include a colorant.

In the present exemplary embodiment, all known dyes and pigments may be used as a colorant that can be used in the toner for developing an electrostatic charge image, and may include, e.g., carbon black, nigrosine dye, iron black, naphthol yellow S, Hansa yellow (10G, 5G, and G), cadmium yellow, yellow iron oxide, loess, chrome yellow, titanium yellow, polyazo yellow, oil yellow, hansa yellow (GR, A, RN, and R), pigment yellow L, benzidine yellow (G and GR), permanent yellow (NCG), vulcan fast yellow (5G, R), tartrazine yellow lake, quinoline yellow lake, anthracene yellow BGL, isoindolinone yellow, bengala, red lead, lead vermilion, cadmium red, cadmium mercury red, antimony scarlet, permanent red 4R, parared, fiser red, parachloroorthonitro aniline red, lithol fast scarlet G, brilliant fast scarlet, brilliant carmine BS, permanent red (F2R, F4R, FRL, FRLL, and F4RH), fast scarlet VD, vulcan fast rubine B, brilliant scarlet G, lithol rubine GX, permanent red FSR, brilliant carmine 6B, pigment scarlet 3B, Bordeaux 5B, toluidine maroon, permanent Bordeaux F2K, Helio Bordeaux BL, Bordeaux 10B, Bon maroon light, Bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indaneethrene blue (RS and BC), indigo, navy blue, royal blue, anthraquinone blue, fast violet B, methyl violet lake, cobalt violet, manganese violet, dioxane violet, anthraquinone violet, chrome green, zinc green, Chromium oxide, viridian, emerald green, pigment green B, naphthol green B, green gold, acid green lake, malachite green lake, phthalocyanine green, anthraquinone green, titanium dioxide, and zinc white, lithopone, and a mixture thereof.

In the present exemplary embodiment, the toner for developing an electrostatic charge image may include a releasing agent, a charge control agent, and the like.

In the present exemplary embodiment, examples of the releasing agent that can be used employed for the toner for developing an electrostatic charge image may include solid paraffin wax, microcrystalline wax, rice bran wax, fatty acid amide-based wax, fatty acid-based wax, aliphatic mono ketones, fatty acid metal salt-based wax, fatty acid ester-based wax, partial saponification fatty acid ester-based wax, silicon varnish, higher alcohol, and carnauba wax. Further, polyolefin such as low molecular weight polyethylene or polypropylene may be employed.

In the present exemplary embodiment, all known charge control agents may be employed for the toner for developing an electrostatic charge image. Examples of the charge control agents may include a nigrosine-based dye, a triphenyl methane-based dye, a chromium-containing metal complex dye, a molybdic acid chelate dye, a rhodamine-based dye, alkoxy-based amine, a quaternary ammonium salt (including a fluorine-modified quaternary ammonium salt), alkyl amide, phosphorus alone or compound, tungsten alone or compound, a fluorine-based activator, a salicylic acid metal salt, and a metal salt of a salicylic acid derivative. Specifically, examples of the charge control agents may include BONTRON 03 of nigrosine-based dye, BONTRON P-51 of quaternary ammonium salt, BONTRON S-34 of metal-containing azo dye, E-82 of oxynaphthoic acid-based metal complex, E-84 of salicylic acid-based metal complex, E-89 of phenol-based condensate (all made by ORIENT CHEMICAL INDUSTRIES CO., LTD), TP-302 and TP-415 of quaternary ammonium salt molybdenum complex (all made by HODOGAYA CHEMICAL CO., LTD), Copy Charge PSY VP2038 of quaternary ammonium salt, Copy Blue PR of triphenyl methane derivative, Copy Charge NEG VP2036 of quaternary ammonium salt, Copy Charge NX VP434

(made by HOECHST AG), boron complex LR-147 and LRA-901 (made by Japan Carlit Co., Ltd.), copper phthalocyanine, pherylene, quinacridone, azo-based pigment, other polymer-based compounds including functional groups such as sulfonic acid group, carboxyl group, quaternary ammonium salt, and the like.

An acid value of the toner for developing an electrostatic charge image is in a range of 3 to 25 mg KOH/g. For example, the acid value may be in a range of 5 to 20 mg KOH/g When the acid value is in the range of 3 to 25 mg KOH/g, it is possible to obtain excellent electrification and charge preservation. If the acid value exceeds 25 mg KOH/g, the charge preservation may be deteriorated. If the acid value is smaller than 3 mg KOH/g, the electrification may be deteriorated.

The acid value of the toner for developing an electrostatic charge image can be controlled by adjusting an acid value of the binder resin.

The acid value of the toner for developing an electrostatic charge image can be measured by using a neutralization titration, which will be described later.

In the present exemplary embodiment, a volume average particle diameter of the toner for developing an electrostatic charge image is in a range of 3 to 9 μm. For example, the volume average particle diameter may be in a range of 3.5 to 5.0 μm. When the volume average particle diameter is in the range of 3 to 9 μm, an elaborate image can be easily formed. If the volume average particle diameter exceeds 9 μm, it is difficult to form an elaborate image. If the volume average particle diameter is smaller than 3 μm, it is difficult to deal with the toner for developing an electrostatic charge image. Further, in the toner for developing an electrostatic charge image according to the present exemplary embodiment, an abundance of particles having a diameter of 3 μm or less may be equal to or smaller than 3% by number. For example, the abundance may be equal to or smaller than 2.5% by number. When the abundance of the particles having the diameter of 3 μm or less is equal to or smaller than 3% by number, the toner for developing an electrostatic charge image may accomplish uniform diameter. If the abundance of the particles having the diameter of 3 μm or less exceeds 3% by number, a diameter deviation of the toner for developing an electrostatic charge image may be increased.

Further, in the present exemplary embodiment, in the toner for developing an electrostatic charge image, an abundance ratio of the particles having the diameter of 3 μm or less to particles having a diameter of 1 μm or less may be in a range of 2.0 to 4.0. For example, the abundance ratio may be in a range of 2.5 to 3.5. When the abundance ratio of the particles having the diameter of 3 μm or less to the particles having the diameter of 1 μm or less is in a range of 2.0 to 4.0, it is possible to suppress the abundance of the particles having the small diameter, which have difficulty to be dealt with, and suppress a deviation of the diameter of the toner for developing an electrostatic charge image. If the abundance ratio of the particles having the diameter of 3 μm or less to the particles having the diameter of 1 μm or less exceeds 4.0, a deviation of the diameter of the toner for developing an electrostatic charge image may be increased. If the abundance ratio of the particles having the diameter of 3 μm or less to the particles having the diameter of 1 μm or less is smaller than 2.0, the abundance of the particles having the small diameter, which have difficulty to be dealt with may be increased.

A volume average particle diameter of the toner for developing an electrostatic charge image can be controlled by adjusting a toner preparing condition and the like.

The abundance of the particles having the diameter of 3 μm or less can be controlled by adjusting a toner preparing condition and the like The abundance ratio of the particles having the diameter of 3 μm or less to particles having the diameter of 1 μm or less can be controlled by adjusting a toner preparing condition and the like.

As will be described later, the volume average particle diameter of the toner for developing an electrostatic charge image can be measured by using an electrical sensing zone method. As will be described later, the abundance of the particles having the diameter of 3 μm or less can be measured by using an electrical sensing zone method. As will be described later, the abundance of the particles having the diameter of 1 μm or less can be measured by using a dynamic light scattering method.

B. A Preparing Method of the Toner for Developing an Electrostatic Charge Image.

In the present exemplary embodiment, the preparing method of the toner for developing an electrostatic charge image includes an amorphous polyester-based resin synthesizing process, an amorphous polyester-based resin latex forming process, a crystalline polyester resin synthesizing process, a crystalline polyester resin latex forming process, a mixed solution forming process, a primary aggregated particle forming process, a coated aggregated particle forming process, a fusing and unity process.

Hereinafter, each process will be described in detail.

1. Amorphous Polyester-Based Resin Synthesizing Process

The amorphous polyester-based resin synthesizing process dehydro-condenses the polycarboxylic acid component and the polyol component in a temperature of 150° C. or less under the presence of a catalyst, urethane-extends a thus-obtained resin, and synthesizes the amorphous polyester-based resin.

The amorphous polyester-based resin synthesizing process includes an esterification process and a urethane extending process.

Hereinafter, the amorphous polyester-based resin synthesizing process will be described process by process.

<Esterification Process>

In the esterification process, first, the polycarboxylic acid component, the polyol component, and the catalyst are put in a reaction vessel. As described above, a general organic polycarboxylic acid may be employed as the polycarboxylic acid component, which can be used to synthesize the amorphous polyester-based resin. Detailed examples of the organic polycarboxylic acid may include maleic anhydride, phthalic anhydride, and succinic acid.

As described above, detailed examples of the polyol component, which can be used to synthesize the amorphous polyester-based resin, may include an ethylene oxide 2 mol adduct or a propylene oxide 2 mol adduct of bisphenol A, but are not limited thereto.

A content rate of the polycarboxylic acid component to a total amount of the polycarboxylic acid component and the polyol component is appropriately determined in consideration of the aforementioned characteristics 1 to 3 of the amorphous polyester-based resin. Specifically, the content rate of the polycarboxylic acid component is in a range of 35 to 50 wt %. For example, the content rate of the polycarboxylic acid component is in a range of 35 to 50 wt %.

When the content rate of the polycarboxylic acid component is in a range of 35 to 50 wt %, it is possible to synthesize the amorphous polyester-based resin having the aforementioned characteristics 1 to 3.

If the content rate of the polycarboxylic acid component exceeds 50 wt %, it may be difficult to obtain a necessary acid value and/or to adjust a molecular weight.

If the content rate of the polycarboxylic acid component is smaller than 35 wt %, it may be difficult to obtain a necessary molecular weight.

As described above, the catalyst, which can be used to synthesize the amorphous polyester-based resin, includes one or more kinds of elements including at least elemental sulfur from among the elemental sulfur and the elemental fluorine.

The catalyst may be one kind of compound or a mixture of two or more kinds of compounds.

A strong acid compound may be employed as the catalyst including one or more kinds of elements including at least elemental sulfur from among the elemental sulfur and the elemental fluorine.

Specifically, detailed examples of this catalyst may include paratoluene sulfonic acid.1 hydrate, dodecyl baenzene sulfonic acid, bis(1,1,2,2,3,3,4,4,4-nonafluoro-1-butan sulfonyl)imide, and scandium(III)triflate.

A content rate of the catalyst included in the mixture of the polycarboxylic acid component, the polyol component, and the catalyst is appropriately determined in consideration of a range of a content rate of the elemental sulfur and the elemental fluorine. Specifically, the content rate of the catalyst is in a range of 0.1 to 2.0 wt % relative to the whole part of the mixture. For example, the content rate of the catalyst may be in a range of 0.5 to 1.5 wt %.

If the content rate of the catalyst is in the range of 0.1 to 2.0 wt %, the content rates of the elemental sulfur and the elemental fluorine may be determined as the aforementioned ranges.

If the content rate of the catalyst exceeds 2.0 wt %, it is not preferable for the coloration of the resin due to a side reaction may be occurred.

If the content rate of the catalyst is smaller than 0.1 wt %, it may be difficult to obtain the polyester resin of sufficient molecular weight.

Thereafter, in the esterification process, an inside of the reaction vessel is changed into an inert gas atmosphere, the mixture of the polycarboxylic acid component, the polyol component, and the catalyst is heated and dissolved to make a mixed solution of the polycarboxylic acid component, the polyol component, and the catalyst.

A heating temperature for dissolving the mixture is appropriately determined in consideration of a type, an amount, or the like of the polycarboxylic acid component, and the polyol component.

Thereafter, the temperature of the mixed solution is increased to a predetermined level that is equal to or lower than 150° C. in the esterification process. This temperature is a synthesizing temperature of the polyester resin.

Next, the reaction vessel is evacuated, and the polyester resin is formed by performing a dehydrocondensation reaction on the polycarboxylic acid component and the polyol component in the synthesizing temperature of the polyester resin during a predetermined time period.

The synthesizing temperature of the polyester resin may be reduced by controlling the mixing ratio and the type of the monomer, and controlling the type of the catalyst.

As described above, the synthesizing temperature is equal to or lower than 150° C. For example, the synthesizing temperature may be in a range of 80 to 100° C.

When the synthesizing temperature is equal to or lower than 150° C., it is possible to suppress an energy consumption when the polyester resin is synthesized. If the synthesizing temperature exceeds 150° C., the energy consumption may be increased when the polyester resin is synthesized.

If the synthesizing temperature is lower than 80° C., a time required to synthesize the polyester resin may be increased.

This synthesizing time of the polyester resin is appropriately determined in consideration of the synthesizing temperature or a type, a mixing ratio, and the like of the poly carbonic acid the component and polyol component used as the monomer.

<Urethane Extending Process>

In the urethane extending process, first, a pressure of a reaction vessel is adjusted to a normal pressure, and then the polyisocyanate component and the organic solvent are added into a solution in which the polyester resin is formed.

As described above, a general polyisocyanate compound may be employed as the polyisocyanate component, which can be used to form the amorphous polyester-based resin. Detailed examples of the polyisocyanate component may include diphenylmethane diisocyanate, toluene diisocyanate, Isophoronediisocyanate, hexamethylenediisocyanate, and norbornene diisocyanate, and an isocyanurate compound of this diisocyanate compound.

An additive amount of the polyisocyanate component is appropriately determined in consideration of a glass transition temperature or of a weight average molecular weight of the amorphous polyester-based resin.

Specifically, the additive amount of the polyisocyanate component is in a range of 3 to 20 wt % relative to a total weight of the polycarboxylic acid component and the polyol component. For example, the additive amount may be in a range of 5 to 15 wt %.

Thereafter, in the urethane extending process, an inside of the reaction vessel is adjusted to an inert gas atmosphere, and the amorphous polyester-based resin is formed by allowing the polyester resin to react with a urethane extending component in a predetermined temperature during a predetermined time period.

A reaction temperature for urethane-extending the polyester resin is appropriately determined in consideration of a reaction time for obtaining a necessary property.

Specifically, the reaction temperature is in a range of 60 to 100° C. For example, the reaction temperature may be in a range of 80 to 100° C.

When the reaction temperature is in the range of 60 to 100° C., it is possible to obtain a necessary property while suppressing energy consumption.

If the reaction temperature exceeds 100° C., the energy consumption may be increased.

If the reaction temperature is lower than 60° C., the reaction time may be non-economically increased.

The reaction time for urethane-extending the polyester resin is appropriately determined in consideration of the reaction temperature or a type, a mixing ratio, and the like of the poly carbonic acid component and polyol component used as the monomer.

The thus-obtained amorphous polyester-based resin includes the following characteristics (1) to (4).

(1) The mole ratio of the aromatic portion to the aliphatic portion is in a range of 4.5 to 5.8.

(2) The glass transition temperature by the differential scanning calorimetry is in a range of 50 to 70° C.

(3) The endothermic gradient of the glass transition temperature is in a range of 0.1 to 1.0 W/g·° C.

(4) The weight average molecular weight is in a range of 5,000 to 50,000 Daltons.

2. Amorphous Polyester-Based Resin Latex Forming Process

The amorphous polyester-based aliphatic latex forming process serves to form an amorphous polyester-based resin latex including an amorphous polyester-based resin.

In the amorphous polyester-based resin latex forming process, first, an amorphous polyester-based resin and an organic solvent are put into the reaction vessel, and the amorphous polyester-based resin is dissolved in the organic solvent.

A content of the amorphous polyester-based resin of the solution including the amorphous polyester-based resin is appropriately determined in consideration of a viscosity thereof.

Examples of the organic solvent, which can be used in the amorphous polyester-based resin latex forming process, may include methylethylketone, isopropylalcohol, ethyl acetate, and a mixed solution thereof.

Thereafter, in the amorphous polyester-based resin latex forming process, an alkaline solution is added into the solution including the amorphous polyester-based resin while the solution including the amorphous polyester-based resin is agitated. Further, water is added thereinto at a predetermined speed to form an emulsion.

The reason of adding the alkaline solution is that it serves to neutralize the amorphous polyester-based resin.

Examples of the alkaline solution, which can be used in the amorphous polyester-based resin latex forming process, may include an aqueous ammonia solution and an aqueous solution of amine compound.

An additive amount of the alkaline solution is appropriately determined in consideration of, e.g., an acidity of the amorphous polyester-based resin.

An additive amount of the water is appropriately determined in consideration of, e.g., a diameter of particles of the thus-obtained latex.

A water-adding speed is appropriately determined in consideration of e.g., a diameter distribution of the particles of the latex.

Thereafter, in the amorphous polyester-based resin latex forming process, the organic solvent is removed from the emulsion until a concentration of the solid amorphous polyester-based resin is adjusted to a predetermined level, thereby obtaining an amorphous polyester-based resin latex including the amorphous polyester-based resin.

A vacuum distillation method may be employed to remove the organic solvent.

A concentration of the amorphous polyester-based resin included in the amorphous polyester-based resin latex is appropriately determined in consideration of e.g., viscosity, preservation stability, and economic efficiency of the latex.

Specifically, the concentration of the amorphous polyester-based resin is in a range of 10 to 50 wt %. For example, the concentration of the amorphous polyester-based resin may be in a range of 20 to 40 wt %.

3. Crystalline Polyester Resin Synthesizing Process

The crystalline polyester resin synthesizing process dehydro-condenses the polycarboxylic acid component and the polyol component in a temperature of 150° C. or less under the presence of a catalyst, and synthesize the crystalline polyester resin.

In the crystalline polyester resin synthesizing process, first, the polycarboxylic acid component, the polyol component, and the catalyst are put in the reaction vessel.

As described above, an aliphatic polycarboxylic acid may be employed as the polycarboxylic acid component, which can be used to synthesize the crystalline polyester resin. Detailed examples of the aliphatic polycarboxylic acid may include an adipic acid, a suberic acid, a decanedioic acid, and a dodecanedioic acid.

As described above, aliphatic polyol may be employed as the polyol component, which can be used to synthesize the crystalline polyester resin. Detailed examples of the aliphatic polyol may include 1,6-hexanediol, 1,8-octanediol, 1,9-nonanediol, and 1,10-decanediol.

As described above, the catalyst, which can be used to synthesize the crystalline polyester resin, includes one or more kinds of elements including at least elemental sulfur from among the elemental sulfur and the elemental fluorine. The catalyst may be one kind of compound or a mixture of two or more kinds of compounds. As described above, examples of the catalyst including one or more kinds of elements including at least elemental sulfur from among the elemental sulfur and the elemental fluorine may include paratoluene sulfonic acid.1hydrate, dodecyl baenzene sulfonic acid, bis(1,1,2,2,3,3,4,4,4-nonafluoro-1-butan sulfonyl)imide, and scandium(III)triflate.

Thereafter, in the crystalline polyester resin synthesizing process, an inside of the reaction vessel is changed into an inert gas atmosphere, the mixture of the polycarboxylic acid component, the polyol component, and the catalyst is heated and dissolved to make a mixed solution of the polycarboxylic acid component, the polyol component, and the catalyst.

Thereafter, the temperature of the mixed solution is increased to a predetermined level that is equal to or lower than 100° C. in the crystalline polyester resin synthesizing process. This temperature is a synthesizing temperature of the polyester resin. Next, the reaction vessel is evacuated, and the crystalline polyester resin is formed by performing a dehydrocondensation reaction on the polycarboxylic acid component and the polyol component in the synthesizing temperature of the polyester resin during a predetermined time period.

The thus-obtained crystalline polyester resin includes the following characteristics (a) to (e).

(a) An endothermic amount in the melting measured by the differential scanning calorimetry is in a range of 2.0 to 10.0 W/g.

(b) The weight average molecular weight is in a range of 5,000 to 15,000 Daltons.

(c) A difference between an endothermic start temperature and an endothermic peak temperature is in range of 3 to 5° C. when the temperature of the crystalline polyester resin is increased in the differential scanning calorimetry curve determined by the differential scanning calorimetry.

(d) One or more kinds of elements including at least elemental sulfur from among the elemental sulfur and the elemental fluorine.

(e) The content rate of the weight average molecular weight of 1,000 Daltons or less is in a range of 1 to less than 10%.

4. Crystalline Polyester Resin Latex Forming Process

The crystalline polyester aliphatic latex forming process forms the crystalline polyester resin latex including the crystalline polyester resin.

In the crystalline polyester resin latex forming process, first, the crystalline polyester resin and the organic solvent are put in the reaction vessel, and the crystalline polyester resin is dissolved in the organic solvent.

A content of the crystalline polyester resin included in the solution including the crystalline polyester resin is appropriately determined in consideration of e.g., viscosity, preservation stability, and economic efficiency of the latex.

Examples of the organic solvent, which can be used in the crystalline polyester resin latex forming process, may include methylethylketone, isopropylalcohol, ethyl acetate, and a mixed solution thereof.

Thereafter, in the crystalline polyester resin latex forming process, an alkaline solution is added into the solution including the crystalline polyester resin while the solution including the crystalline polyester resin is agitated. Further, water is added thereinto at a predetermined speed to form an emulsion.

The reason of adding the alkaline solution is that it serves to neutralize the crystalline polyester resin. Examples of the alkaline solution, which can be used in the crystalline polyester resin latex forming process, may include an aqueous ammonia solution and an aqueous solution of amine compound. An additive amount of the alkaline solution is appropriately determined in consideration of, e.g., an acidity of the crystalline polyester resin.

An additive amount of the water is appropriately determined in consideration of, e.g., a diameter of particles of the latex. A water-adding speed is appropriately determined in consideration of e.g., a diameter distribution of the particles of the latex.

Thereafter, in the crystalline polyester resin latex forming process, the organic solvent is removed from the emulsion until a concentration of the solid crystalline polyester resin is adjusted to a predetermined level, thereby obtaining a crystalline polyester resin latex including the crystalline polyester resin.

The vacuum distillation method may be employed to remove the organic solvent.

A concentration of the crystalline polyester resin included in the crystalline polyester resin latex is appropriately determined in consideration of e.g., viscosity, preservation stability, and economic efficiency of the latex. Specifically, the concentration of the crystalline polyester resin is in a range of 10 to 50 wt %. For example, the concentration of the crystalline polyester resin may be in a range of 20 to 40 wt %.

5. Mixed Solution Forming Process

The mixed solution forming process forms the mixed solution by mixing at least the amorphous polyester-based resin latex and the crystalline polyester resin latex, and a colorant dispersion liquid including a colorant and/or a releasing agent dispersion liquid including a releasing agent if necessary.

If necessary, the mixed solution forming process includes a colorant dispersion liquid forming process, a releasing agent dispersion liquid forming process, and a mixing process.

Hereinafter, the mixed solution forming process will be described process by process.

<Colorant Dispersion Liquid Forming Process>

In the colorant dispersion liquid forming process, first, a colorant, an anionic surfactant, and a dispersion medium are put in a reaction vessel.

In the present exemplary embodiment, all known dyes and pigments may be used as a colorant that can be used in the toner for developing an electrostatic charge image, and may include, e.g., carbon black, nigrosine dye, iron black, naphthol yellowS, Hansa yellow (10G, 5G, and G), cadmium yellow, yellow iron oxide, loess, chrome yellow, titanium yellow, polyazo yellow, oil yellow, hansa yellow (GR, A, RN, and R), pigment yellow L, benzidine yellow (G and GR), permanent yellow (NCG), vulcan fast yellow (5G, R), tartrazine yellow lake, quinoline yellow lake, anthracene yellow BGL, isoindolinone yellow, bengala, red lead, lead vermilion, cadmium red, cadmium mercury red, antimony scarlet, permanent red 4R, para red, fiser red, para nitroaniline red, lithol fast scarlet G, brilliant fast scarlet, brilliant carmine BS, permanent red (F2R, F4R, FRL, FRLL, and F4RH), fast scarlet VD, vulcan fast rubine B, brilliant scarlet G, lithol rubine GX, permanent red FSR, brilliant carmine 6B, pigment scarlet 3B, Bordeaux 5B, toluidine maroon, permanent Bordeaux F2K, Helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, victoria blue lake, metal-free phthalocyanine blue, phthalocyanine blue, fast sky blue, indaneethrene blue (RS and BC), indigo navy blue, royal blue, anthraquinone blue, fast violet B, methyl violet lake, cobalt violet, manganese violet, dioxane violet, anthraquinone violet, chrome green, zinc green, Chromium oxide, viridian, emerald green, pigment green B, naphthol green B, green gold, acid green lake, malachite green lake, phthalocyanine green, anthraquinone green, titanium dioxide, zinc white, and lithopone, and a mixture thereof. A content of the coolant included in a mixture of the coolant, the anionic surfactant, and the dispersion medium is appropriately determined in consideration of, e.g., a dispersed state thereof.

For example, alkyl benzene sulfonate may be employed as the anionic surfactant, which can be used in the colorant dispersion liquid forming process. A content of the anionic surfactant included in the mixture including the colorant, the anionic surfactant, and the dispersion medium is appropriately determined in consideration of, e.g., the dispersed state of the coolant.

Glass beads may be employed as the dispersion medium, which can be used in the colorant dispersion liquid forming process.

A content of the dispersion medium included in the mixture including the colorant, the anionic surfactant, and the dispersion medium is appropriately determined in consideration of, e.g., a dispersion time and the dispersed state of the coolant.

Thereafter, in the colorant dispersion liquid forming process, a colorant dispersion liquid is obtained by performing a dispersing process on the mixture including the colorant, the anionic surfactant, and the dispersion medium. A method of performing the dispersing process may be performed by using a milling bath, an ultrasonic disperser, and a microfluidizer.

<Releasing Agent Dispersion Liquid Forming Process>

In the releasing agent dispersion liquid forming process, first, the releasing agent, the anionic surfactant, and water are put in the reaction vessel.

In the present exemplary embodiment, examples of the releasing agent which can be used for the toner for developing an electrostatic charge image may include solid paraffin wax, microcrystalline wax, rice bran wax, fatty acid amide-based wax, fatty acid-based wax, aliphatic mono ketones, fatty acidmetal salt-based wax, fatty acid ester-based wax, partial saponification fatty acid ester-based wax, silicon varnish, higher alcohol, carnauba wax, and the like.

Further, polyolefin such as low molecular weight polyethylene and polypropylene may be employed. A content of the releasing agent included in the mixture including the releasing agent, the anionic surfactant, and the water is appropriately determined in consideration of, e.g., dispersed state thereof.

Alkyl benzene sulfonate may be employed as the anionic surfactant, which can be used in the releasing agent dispersion liquid forming process.

A content of the anionic surfactant included in the mixture including the releasing agent, the anionic surfactant, and the water is appropriately determined in consideration of, e.g., dispersed state thereof.

A content of the water included in the mixture including the releasing agent, the anionic surfactant, and the water is appropriately determined in consideration of, e.g., dispersed state, preservation, economic efficiency.

Thereafter, in the releasing agent dispersion liquid forming process, a dispersing process is performed on the mixture including the releasing agent, the anionic surfactant, and the water, thereby obtaining a releasing agent dispersion liquid.

A method of using a homogenizer may be employed to perform the dispersing process on the mixture.

<Mixing Process>

In the mixing process, first, an amorphous polyester-based resin latex and a crystalline polyester resin latex are put in the reaction vessel.

Thereafter, a mixture including the amorphous polyester-based resin latex and the crystalline polyester resin latex, and the water is agitated. And if necessary, colorant dispersion liquid and/or a releasing agent dispersion liquid are added into the mixture, and if necessary, a mixed solution including the amorphous polyester-based resin latex and the crystalline polyester resin latex, and the releasing agent dispersion liquid and/or the colorant dispersion liquid having the colorant are added into the mixture.

An input of the amorphous polyester-based resin latex is appropriately determined in consideration of, e.g., a toner property.

An input of the crystalline polyester resin latex is appropriately determined in consideration of, e.g., the toner property.

An input of the water is appropriately determined in consideration of, e.g., a viscosity of the mixture and economic efficiency.

An input of the colorant dispersion liquid is appropriately determined in consideration of, e.g., a toner tinting strength.

An input of the releasing agent dispersion liquid is appropriately determined in consideration of, e.g., the toner property.

6. Primary Aggregated Particles Forming Process

The primary aggregated particles forming process forms primary aggregated particles by adding a flocculant into the mixed solution and by aggregating the amorphous polyester-based resin and the crystalline polyester resin, and the colorant and/or the releasing agent if necessary.

In the primary aggregated particles forming process, first, the flocculant and an acidic solution are added into the mixed solution including the amorphous polyester-based resin latex and the crystalline polyester resin latex, and the colorant dispersion liquid and/or the releasing agent dispersion liquid if necessary while agitating the mixed solution.

A flocculant including elemental iron and elemental silicon may be employed in the primary aggregated particles forming process. An iron-based metal salt may be employed as the flocculant including the elemental iron and the elemental silicon. Specifically, polysilicate iron may be employed as the flocculant including the elemental iron and the elemental silicon.

An additive amount of the flocculant is appropriately determined in consideration of, e.g., content ranges of the elemental iron and the elemental sulfur. Specifically, the additive amount of the flocculant is in a range of 0.15 to 1.5 wt % for the entire mixed solution. For example, the additive amount may be in a range of 0.3 to 1.0 wt %. When the additive amount is in the range of 0.15 to 1.5 wt %, the contents of the elemental iron and the elemental sulfur may have aforementioned ranges. If the additive amount of the flocculant exceeds 1.5 wt %, the toner property may be excessively increased. If the additive amount of the flocculant is smaller than 0.15 wt %, the aggregation may be deteriorated, thereby making it difficult to form toner particles.

The acidic solution makes the mixed solution acidic to promote an aggregation

A nitric acid solution or a hydrochloric acid solution may be employed as the acidic solution, which can be used in the primary aggregated particles forming process.

An additive amount of the acidic solution is appropriately determined in consideration of, e.g., alkalinity of the mixed solution.

Thereafter, in the primary aggregated particles forming process, a dispersing process is performed on the solution into which the flocculant and the acidic solution are added, and a temperature of the solution is increased at a predetermined temperature-increasing speed.

In this case, the amorphous polyester-based resin and the crystalline polyester resin are aggretrated together with the colorant and/or the releasing agent if necessary, and thus primary aggregated particles having a predetermined volume average particle diameter are formed, thereby obtaining a primary aggregated particle dispersion liquid including the primary aggregated particles.

The volume average particle diameter of the obtained primary aggregated particles may be controlled by adjusting an agitating speed of the dispersing process or the temperature-increasing speed and an agglutination time. The volume average particle diameter of the primary aggregated particles is appropriately determined in consideration of the toner particle diameter. Specifically, the volume average particle diameter of the primary aggregated particles may be in a range of 2.5 to 8.5 μm. For example, the volume average particle diameter may be in a range of 3.0 to 4.5 μm.

After the flocculant and the acidic solution are added, the temperature-increasing speed of the solution is appropriately determined in consideration of the diameter of the primary aggregated particles.

A dispersing process method of the solution after the flocculant and the acidic solution are added may be executed by using a homogenizer.

7. Coated Aggregated Particle Forming Process

The coated aggregated particle forming process forms coated aggregated particles by forming coating layers on the primary aggregated particles.

In the coated aggregated particle forming process, first, the amorphous polyester-based resin latex is added into the primary aggregated particle dispersion liquid including the primary aggregated particles, and the coating layers formed of the amorphous polyester-based resin are disposed on external surfaces of the primary aggregated particles by aggregating the primary aggregated particles and the amorphous polyester-based resins for a predetermined aggregation time.

Accordingly, a coated aggregated particle dispersion liquid having the coated aggregated particles including the coating layers disposed on the external surfaces thereof.

An additive amount of the amorphous polyester-based resin latex is appropriately determined in consideration of, e.g., the toner property.

The aggregation time is appropriately determined in consideration of a diameter of the toner particles.

Thereafter, in the coated aggregated particle forming process, pH is adjusted by adding an alkaline solution into the coated aggregated particle dispersion liquid, thereby stopping the aggregation.

Examples of the alkaline solution, which can be used to stop the aggregation, may include an aqueous sodium hydroxide solution and an aqueous potassium hydroxide solution An additive amount of the alkaline solution is appropriately determined in consideration of, e.g., acidity of the coated aggregated particle dispersion liquid.

8. Fusing and Unity Process

The fusing and unity process fuses and unities the coated aggregated particles in a temperature that is higher than the glass transition temperature of the amorphous polyester-based resin.

Specifically, the fusing and unity process fuses and unities particles included in the coated aggregated particle dispersion liquid by performing a treatment on the coated aggregated particle dispersion liquid in the temperature that is higher than the glass transition temperature of the amorphous polyester-based resin. Accordingly, toner particles having a predetermined volume average particle diameter, which include the coating layers disposed on the external surfaces thereof are formed, thereby obtaining a toner particle dispersion liquid including the toner particles.

A temperature and a time for the fusion and unity is appropriately determined in consideration of the toner property, shape, and economic efficiency.

After the fusing and coalescing process, the toner particles are separated from the toner particle dispersion liquid.

A method of separating the toner particles from the toner particle dispersion liquid may be executed by filtration.

The thus-obtained toner particles have the following characteristics (A) to (G).

(A) Three or more kinds of elements including at least elemental iron, elemental silicon and elemental sulfur from among elemental iron, elemental silicon, elemental sulfur and elemental fluorine are included.

(B) A content of the elemental iron is in a range of $1.0\times10^3$ to $1.0\times10^4$ ppm, a content of the elemental silicon is in a range of $1.0\times10^3$ to $5.0\times10^3$ ppm, and a content of the elemental sulfur is in a range of 500 to 3,000 ppm.

In the case of including the elemental fluorine, a content of the elemental fluorine is in a range of $1.0\times10^3$ to $1.0\times10^4$ ppm.

(C) An acid value is in a range of 3 to 25 mg KOH/g.

(D) A volume average particle diameter is in a range of 3 to 9 μm.

(E) An abundance of the particles having the diameter of 3 μm or less is equal to or smaller than 3% by number.

(F) An abundance ratio of the particles having the diameter of 3 μm or less to particles having a diameter of 1 μm or less is in a range of 2.0 to 4.0.

(G) A thickness of the coating layer is in a range of 0.2 to 1.0 μm.

C. Effect

In the present exemplary embodiment, the toner for developing an electrostatic charge image includes three or more kinds of elements including at least elemental iron, elemental silicon and elemental sulfur from among elemental iron, elemental silicon, elemental sulfur and elemental fluorine. A content of the elemental iron is in a range of $1.0\times10^3$ to $1.0\times10^4$ ppm, a content of the elemental silicon is in a range of $1.0\times10^3$ to $5.0\times10^3$ ppm, and a content of the elemental sulfur is in a range of 500 to 3,000 ppm. In the case of including the elemental fluorine, a content of the elemental fluorine is in a range of $1.0\times10^3$ to $1.0\times10^4$ ppm.

Further, the binder resin may include at least the amorphous polyester-based resin and the crystalline polyester resin.

The amorphous polyester-based resin include: (1) a mole ratio of an aromatic portion to an aliphatic portion which is in a range of 4.5 to 5.8, (2) a glass transition temperature measured by a differential scanning calorimetry which is in a range of 50 to 70° C., and (3) an endothermic gradient in the glass transition temperature which is in a range of 0.1 to 1.0 W/g·° C.

The crystalline polyester resin include: (a) an endothermic amount in the melting measured by the differential scanning calorimetry which is in a range of 2.0 to 10.0 W/g, (b) a weight average molecular weight which is in a range of 5,000 to 15,000, Daltons (c) a difference between an endothermic start temperature and an endothermic peak temperature which is in range of 3 to 5° C. when the temperature of the crystalline polyester resin is increased in the differential scanning calorimetry curve determined by the differential scanning calorimetry, (d) one or more kinds of elements including at least elemental sulfur from among the elemental sulfur and the elemental fluorine, and (e) a content rate of the weight average molecular weight of 1,000 Daltons or less which is in a range of 1 to less than 10%.

Accordingly, it is possible to obtain a toner for developing an electrostatic charge image capable of obtaining excellent low-temperature fixedness and preservation and suppressing energy consumption in a toner preparation.

According to an exemplary embodiment of the present exemplary embodiment, the method for preparing a toner for developing an electrostatic charge image may include an amorphous polyester-based resin synthesizing process for dehydro-condensing a polycarboxylic acid component and a polyol component in a temperature of 150° C. or less under the presence of a catalyst, urethane-extending a thus-obtained resin, and synthesizing the amorphous polyester-based resin; an amorphous polyester-based resin latex forming process for forming a latex of the amorphous polyester-based resin; a crystalline polyester resin synthesizing process for synthersizing a crystalline polyester resin by dehydro-condensing an aliphatic polycarboxylic acid component and an aliphatic polyol component in a temperature of 100° C. or less under the presence of a catalyst; a crystalline polyester resin latex forming process for forming a latex of the crystalline polyester resin; a mixed solution forming process for forming a mixed solution by mixing at least the amorphous polyester-based resin latex and the crystalline polyester resin latex; a primary aggregated particle forming process for adding a flocculant into the mixed solution, and forming a primary aggregated particle by aggregating the amorphous polyester-based resin and the crystalline polyester resin; a coated aggregated particle forming process for forming a coated aggregated particle by disposing a coating layer formed of the amorphous polyester-based resin on a surface of the primary aggregated particle; and a fusing and coalescing process for fusing and coalescing the coated aggregated particle in a temperature that is higher than a glass transition temperature of the amorphous polyester-based resin.

Herein, the amorphous polyester-based resin include: (1) a mole ratio of an aromatic portion to an aliphatic portion which is in a range of 4.5 to 5.8, (2) a glass transition temperature measured by a differential scanning calorimetry which is in a range of 50 to 70° C., and (3) an endothermic gradient in the glass transition temperature which is in a range of 0.1 to 1.0 W/g·° C.

The crystalline polyester resin include: (a) an endothermic amount in the melting measured by the differential scanning calorimetry which is in a range of 2.0 to 10.0 W/g, (b) a weight average molecular weight which is in a range of 5,000 to 15,000 Daltons, (c) a difference between an endothermic start temperature and an endothermic peak temperature which is in range of 3 to 5° C. when the temperature of the crystalline polyester resin is increased in the differential scanning calorimetry curve determined by the differential scanning calorimetry, (d) one or more kinds of elements including at least elemental sulfur from among the elemental sulfur and the elemental fluorine, and (e) a content rate of the weight average molecular weight of 1,000 Daltons or less which is in a range of 1 to less than 10%.

The catalyst includes one or more kinds of elements including at least elemental sulfur from among the elemental sulfur and the elemental fluorine.

The flocculant includes the elemental iron and the elemental silicon.

Accordingly, it is possible to prepare a toner for developing an electrostatic charge image capable of obtaining excellent low-temperature fixedness and preservation and suppressing energy consumption in a toner preparation.

EXAMPLE

Hereinafter, the exemplary embodiments will be described in detail according to Examples and Comparative Examples.

Further, the following Examples are examples and are shall not be limiting.

First, various measuring methods and evaluating methods will be described before the Examples and Comparative Examples are described.

<Mole Ratio of Aromatic Portion to Aliphatic Portion>

The mole ratio of the aromatic portion to the aliphatic portion was obtained by analysizing an ultraviolet absorption spectrum.

Specifically, an ultraviolet spectrum in a wavelength range of 220 to 340 nm was measured by a light transmittance ultraviolet visible spectrometer (U-3410, made by Hitachi, Ltd.), and two points (236 nm-310 nm) indicating minimum intensity were connected and determined as a baseline.

A vertical line was drawn from a maximum absorbance (around 270 nm), and a length of the vertical line was determined as an absorbance. Then, a molar amount of the aromatic portion was calculated by using a calibration curve made from phenol of known concentration. The other portions were as the aliphatic portion, and the mole ratio of the aromatic portion to the aliphatic portion was obtained.

<Glass Transition Temperature> and <Endothermic Gradient in Glass Transition Temperature>

The glass transition temperature (° C.) and the endothermic gradient (W/g·° C.) in the glass transition temperature were obtained from a differential scanning calorimetry curve measured by using a differential scanning calorimeter defined in ASTM D3418-08.

Specifically, a first temperature-increased process was performed by increasing a temperature from a room temperature to 150° C. at a speed of 10° C. per minute using a differential scanning calorimeter (Q2000, made by TA Instruments, Inc., and maintaining the temperature to be 150° C. for 5 minutes. Then, the temperature was decreased to 0° C. at a speed of 10° C. per minute by using liquified nitrogen.

The temperature was maintained to be 0° C. for 5 minutes, and then a second temperature-increased process was performed by increasing a temperature from 0° C. to 150° C. at the speed of 10° C. per minute. The glass transition temperature and the endothermic gradient in the glass transition temperature were obtained from the obtained differential scanning calorimetry curve.

<Endothermic Amount when Crystalline Polyester Resin was Melted> and <Difference Between Endothermic Start Temperature and Endothermic Peak Temperature when Temperature was Increased>

The endothermic amount (W/g) when the crystalline polyester resin was melted and the difference between the endothermic start temperature and endothermic peak temperature were obtained from a differential scanning calorimetry curve measured by using the differential scanning calorimeter (DSC) defined in ASTM D3418-08.

Specifically, a first temperature-increased process was performed by increasing a temperature from a room temperature to 150° C. at a speed of 10° C. per minute using the differential scanning calorimeter (Q2000, made by TA Instruments, Inc.), and maintaining the temperature to be 150° C. for 5 minutes. Then, the temperature was decreased to 0° C. at a speed of 10° C. per minute by using liquified nitrogen.

The temperature was maintained to be 0° C. for 5 minutes, and then a second temperature-increased process was performed by increasing a temperature from 0° C. to 150° C. at the speed of 10° C. per minute. The endothermic amount when the crystalline polyester resin was melted and the difference between the endothermic start temperature and endothermic peak temperature were obtained from the obtained differential scanning calorimetry curve.

<Weight Average Molecular Weight> and <Content Rate of Weight Average Molecular Weight of 1,000 Daltons or Less>

The weight average molecular weight and the content rate of the weight average molecular weight of 1,000 Daltons or less were measured by using a gel permeation chromatography (GPC).

Specifically, Waters e2695 (made by Japan Waters Co., Ltd.) were employed as a measuring device, and Inertsil CN-325 cm two series (made by GL Sciences Inc.) were employed in a column.

And, 30 mg of a polyester resin was inserted into 20 mL of tetrahydrofuran (THF) (containing a stabilizer, made by Wako Pure Chemical Industries, Ltd.) to be agitated for one hour, and then a filtrate which was filtered through a 0.2 μm filter used as a sample.

20 μL of a sample solution of tetrahydrofuran (THF) was injected into the measuring device, and was measured under a condition of s temperature of 40° C. and a flow rate of 1.0 mL/min.

<Elemental Content>

Contents of the elemental iron, the elemental silicon, the elemental sulfur, and the elemental fluorine were obtained by using X-ray fluorescence analysis. Specifically, an X-ray fluorescent analyzer EDX-720 (made by SHIMADZU Co., Ltd.) was employed as the measuring device, and the contents of the elemental iron, the elemental silicon, the elemental sulfur, and the elemental fluorine were measured under a condition of an X-ray tube voltage of 50 kV and a sample formation amount of 30.0 g.

The content of each element was calculated by using the intensity of a quantitative result derived by X-ray fluorescence measurement (cps/μA).

<Acid Value>

An acid value (mg KOH/g) was calculated according to a neutralization titration of an acid value measuring method defined in JIS K 0070-1992 (Test method of acid values, saponification values, ester values, iodine values, hydroxyl values, and saponification values of chemical products).

<Hydroxyl Value>

The hydroxyl values (mg KOH/g) was calculated according to a neutralization titration of an hydroxyl value measuring method defined in JIS K 0070-1992 (Test method of acid values, saponification values, ester values, iodine values, hydroxyl values, and saponification values of chemical products).

<Volume Average Particle Diameter>

The volume average particle diameter was measured by using an electrical sensing zone method.

Specifically, a coulter counter (made by Beckman Coulter, Inc.) was employed as a measuring device, ISOTON II (made by Beckman Coulter, Inc.) was employed as an electrolyte solution, and an aperture tube having an aperture diameter of 100 μm was employed. The volume average particle diameter was measured under a condition of a measured particle number of 30,000.

A volume occupied by particles included in the divided particle size range was accumulated from the small diameter side based on a particle size distribution of measured particles, and a particle diameter at the cumulative 50% was defined as a volume average particle diameter Dv50.

<Abundance of Particles Having Diameter of 3 μm or Less>

The abundance of the particles having the diameter of 3 μm or less was measured by using an electrical sensing zone method.

Specifically, a coulter counter (made by Beckman Coulter, Inc.) was employed as a measuring device, ISOTON II (made by Beckman Coulter, Inc.) was employed as an electrolyte solution, and an aperture tube having an aperture diameter of 100 μm was employed. The abundance of the particles having the diameter of 3 μm or less was measured under a condition of a measured particle number of 30,000.

A % by number of the particles having the diameter of 3 μm or less was determined as the abundance of the particles having the diameter of 3 μm or less based on the particle size distribution of the measured particles.

<Abundance of Particles Having Diameter of 1 μm or Less>

The abundance of the particles having the diameter of 1 μm or less was measured by using a dynamic light scattering method.

Specifically, a nano track particle size distribution measuring device (manufactured by Nikkiso Co., Ltd.) was employed as a measuring device.

A % by number of the particles having the diameter of 1 μm or less was determined as the abundance of the particles having the diameter of 1 μm or less based on the particle size distribution of the measured particles.

<Fixedness Evaluation>

A belt-type fuser (for a color laser 660 model (tradename) manufactured by Samsung Electronics Co. Ltd) was employed, and an unfixed test image of 100% solid pattern was fixed onto a 60 g test paper (X-9 (tradename) made by Boise, Inc. under a condition of a fixing speed of 160 mm/sec. and a fixing time of 0.08 sec. The fixation of the unfixed test image was performed at each temperature of 5° C. interval in the range of 100° C. to 180° C.

An initial optical density (OD) of the fixed image was measured. Next, a 3M 810 tape is adhered around the image, and then a weight of 500 g reciprocates 5 times thereon. Then, the tape was removed. Thereafter, the optical density (OD) after the removal of the tape was measured.

A fixing temperature (° C.) was determined as a lowest temperature that satisfied the fixedness of 90% or more, which was calculated by the following equation.

$$\text{Fixedness (\%)} = (\text{optical density after removal of tape/initial optical density}) \times 100$$

<Fixedness Evaluation after Long-Term Preservation>

A toner was left under a condition (high temperature and high humidity) of a temperature of 40° C. and a relative humidity of 95% for 10 days, and then a fixedness (%) of the toner was obtained by using the method described in <Fixedness evaluation>. A fixing temperature (° C.) after long-term preservation was determined as a lowest temperature that satisfied the fixedness of 90% or more.

<Preservation Evaluation>

A 100 g toner is inserted into a mixer (KM-LS2K (tradename), manufactured by Daewha TECH Co., and then 0.5 g NX-90 (made by Japan Aerosil Co., Ltd.), 10 g RX-200 (made by Japan Aerosil Co., Ltd.), and 0.5 g SW-100 (made by Titanium Industry Co., Ltd.) were added thereto as external additives.

Next, the toner was agitated at an agitating speed of 8,000 rpm for 4 minutes to adhere the external additives onto toner particles.

Thereafter, the toner with the external additives attached thereon is inserted into a developing machine (for the color laser 660 model (tradename) manufactured by Samsung Electronics Co. Ltd), and was preserved under a condition (room temperature and room humidity) of a temperature of 23° C. and a relative humidity of 55% for 2 hours, and was also preserved under a condition (high temperature and high humidity) of a temperature of 40° C. and a relative humidity of 90% for 48 hours.

As such, after the toner was preserved under such conditions, existence of caking of the toner included in the developing machine was observed by naked eye. Further, an image of 100% solid pattern was outputted, and the outputted image was observed by naked eye. The preservation was evaluated as follows.

○: Good image, no caking

Δ: Poor image, no caking x: Caking existed

<Electrification Evaluation>

28.5 g magnetic carrier (SY129 (tradename) made by KDK Co. and 1.5 g toner were put into a 60 ml glass vessel.

Next, they were agitated under the condition (room temperature and room humidity) of the temperature of 23° C. and the relative humidity of 55% by using a Turbula mixer.

A charging saturation curve that indicated a relationship between an agitating time and a charging amount of the toner was created by measuring the charging amount of the toner every predetermined agitating time by an electric field separation, and the electrification was evaluated.

○: When a fluctuation range was very small after saturated charging since the charging saturation curve was smooth Δ: When the charging saturation curve was slightly jumped, or the fluctuation range slightly existed (maximum 30%) after saturated charging x: When charging was not saturated or the fluctuation range is large (30% or more) after saturated charging Next, Preparation Examples 1-12 of the amorphous polyester-based resin employed in Examples and Comparative Examples will be described.

Preparation Example (PE)1

Esterification Process 100 g of propylene oxide 2 mol adduct (Adeka polyether BPX-11 (tradename), made by Adeka Corp.) of bisphenol A, 34.74 g of maleic anhydride (MA (abbreviation), made by Adeka Corp.), and 0.98 g of para-toluene sulfonic acid monohydrate (PTSA (abbreviation), made by Wako Pure Chemical Industries, Ltd.) were inserted into a separable 500 ml flask equipped with a reflux condenser, a moisture separator, a nitrogen gas inlet tube, a thermometer, and an agitator.

Then, nitrogen was introduced into the flask, and a mixture of the propylene oxide 2 mol adduct of the bisphenol A, maleic anhydride, and paratoluenesulfonic acid.1hydrate was heated to a temperature 70° C. to be dissolved while the flask was agitated by the agitator.

Next, the mixed solution in the flask was heated to a temperature of 97° C. while the flask is agitated.

Thereafter, an inside of the flask was evacuated to 10 mPa·s or less, and a dehydro-condensation reaction was performed between propylene oxide 2 mol adduct of bisphenol A and maleic anhydride in the temperature of 97° C. for 45 hours, thereby forming the polyester resin.

Some of the polyester resin formed in the esterification process was taken from the flask, and a property thereof was checked.

The obtained polyester resin includes a hydroxyl value of 53.00 mg KOH/g, an acid value of 10.56 mg KOH/g, and a weight average molecular weight of 4,050 Daltons.

<Urethane Extending Process>

An inside pressure of the flask was returned to a normal level, and 9.06 g of diphenylmethane diisocyanate (MDI (abbreviation), made by Wako Pure Chemical Industries, Ltd.) and 28.96 g of toluene (manufactured by Wako Pure Chemical Industries, Ltd.) were added into the flask.

Then, nitrogen was introduced into the flask, and a urethane-extended polyester resin is formed by allowing the polyester resin obtained in the esterification process to react with non-reacted diphenylmethane diisocyanate in a temperature of 97° C. until the non-reacted diphenylmethane diisocyanate disappeared, while the flask was agitated.

The disappearance of the non-reacted diphenylmethane diisocyanate was checked by measuring some of the solution taken from the flask using an infrared spectrophotometer, and was confirmed by disappearance of a peak derived from the isocyanate around 2275 $cm^{-1}$.

<Recovery Process>

An amorphous polyester-based resin MPA-1 was obtained by evaporating toluene from the solution in which the polyester resin that had completely been subjected to the urethane-extension, which was obtained from the urethane extending process.

In the obtained amorphous polyester-based resin MPA-1, the mole ratio of the aromatic portion to the aliphatic portion was 4.6, the acid value was 9.90 mg KOH/g, the weight average molecular weight was 18,420 Daltons, the glass transition temperature was 58° C., and the endothermic gradient in the glass transition temperature was 0.22 W/g·° C.

Preparation Examples 2 to 12

In Preparation Examples 2 to 12, amorphous polyester-based resins MPA-2 to MPA-12 were respectively obtained by adjusting environments to be the same as those of Preparation Example 1 except for varying preparation conditions as shown in Table 1.

Table 1 shows preparation conditions and properties of the amorphous polyester-based resins MPA-1 to MPA-12 obtained in Preparation Examples (PE) 1 to 12.

TABLE 1

| | PE1 | PE2 | PE3 | PE4 | PE5 | PE6 |
|---|---|---|---|---|---|---|
| BPX-11 (g) | 100 | 100 | 100 | 120 | 100 | 100 |
| MA (g) | 34.74 | 34.74 | 34.74 | 2.3 | 34.74 | 34.74 |
| PanH (g) | — | — | — | 31.27 | — | — |
| PTSA (g) | 0.98 | 0.98 | 0.98 | 2 | 2.26 | 0.5 |
| Nf2NH (g) | — | — | — | — | — | — |
| TBT (g) | — | — | — | — | — | — |
| Reaction temperature (° C.) | 97 | 97 | 97 | 97 | 97 | 97 |
| Reaction time (hr) | 45 | 45 | 45 | 45 | 45 | 45 |
| Mw | 4,050 | 4,050 | 4,050 | 4,090 | 4,060 | 4,060 |
| OHV (mgKOH/g) | 53 | 53.06 | 53.06 | 48.71 | 53.06 | 46.51 |
| AV (mgKOH/g) | 10.56 | 10.56 | 10.56 | 9.78 | 10.62 | 7.76 |
| Diisocyanatecompound (g) | 9.06 | 9.06 | 6.09 | 8.39 | 9.06 | 10.66 |
| Toluene (g) | 28.96 | 28.96 | 28.96 | 32.61 | 29.21 | 29.30 |
| Reaction temperature (° C.) | 97 | 97 | 97 | 97 | 97 | 97 |
| Ratio of aromatic/aliphatic | 4.6 | 4.6 | 4.6 | 5.8 | 4.6 | 4.7 |
| AV (mgKOH/g) | 9.90 | 9.90 | 9.90 | 9.28 | 9.96 | 7.20 |
| Mw | 18,420 | 18,400 | 16,800 | 18,730 | 18,440 | 18,200 |
| Tg (° C.) | 58 | 59 | 52 | 59 | 58 | 57 |
| Endothermic gradient (W/g · ° C.) | 0.22 | 0.23 | 0.34 | 0.15 | 0.22 | 0.24 |

| | PE7 | PE8 | PE9 | PE10 | PE11 | PE12 |
|---|---|---|---|---|---|---|
| BPX-11 (g) | 100 | 100 | 100 | 100 | 100 | 110 |
| MA (g) | 34.74 | 34.74 | 34.74 | 34.74 | 34.74 | — |
| PanH (g) | — | — | — | — | — | 100 |
| PTSA (g) | 1.08 | — | 1.08 | 4.46 | 0.3 | — |

TABLE 1-continued

| | | | | | | |
|---|---|---|---|---|---|---|
| Nf2NH (g) | — | 2.50 | — | — | — | — |
| TBT (g) | — | — | — | — | — | 0.1 |
| Reaction temperature (° C.) | 97 | 97 | 97 | 97 | 97 | 240 |
| Reaction time (hr) | 40 | 45 | 40 | 45 | 45 | 24 |
| Mw | 3,120 | 3,950 | 2,590 | 4,050 | 4,000 | 18100 |
| OHV (mgKOH/g) | 61.56 | 53 | 68.08 | 53.06 | 48.57 | |
| AV (mgKOH/g) | 19.11 | 11.29 | 32.52 | 10.62 | 9.72 | 10.93 |
| Diisocyanatecompound (g) | 11.21 | 9.06 | 12.81 | 10.75 | 8.46 | — |
| Toluene (g) | 29.41 | 28.96 | 29.73 | 29.29 | 28.79 | — |
| Reaction temperature (° C.) | 97 | 97 | 97 | 97 | 97 | — |
| Ratio of aromatic/aliphatic | 4.6 | 4.6 | 4.6 | 4.6 | 4.6 | 5.9 |
| AV (mgKOH/g) | 17.65 | 9.90 | 30.30 | 9.91 | 9.15 | 8.31 |
| Mw | 18,310 | 17,200 | 18,050 | 47,600 | 6,500 | 15,400 |
| Tg (° C.) | 60 | 55 | 60 | 61 | 51 | 60 |
| Endothermic gradient (W/g · ° C.) | 0.20 | 0.22 | 0.19 | 0.19 | 0.27 | 0.09 |

In Table 1, "BPX-11" indicates an input of propylene oxide 2 mol adduct of bisphenol A, "MA" indicates an input of maleic anhydride, "PanH" indicates an input of phthalic anhydride, "PTSA" indicates an input of paratoluene sulfonic acid.1hydrate, "Nf2NH" indicates an input of bis(1,1,2,2,3,3,4,4,4-nonafluoro-1-butan sulfonyl)imide, and "TBT" indicates an input of tetra-n-butoxy titanium.

Further, in Table 1, "Reaction temperature" and "Reaction time" at an upper side respectively indicate a reaction temperature and a reaction time in the esterification process.

In addition, "Mw" indicates a weight molecular weight of polyester resin obtained in the esterification process, "OHV" indicates a hydroxyl value of polyester resin obtained in the esterification process, and "AV" at the upper side indicates an acid value of polyester resin obtained in the esterification process.

"Reaction temperature" at a lower side indicates a reaction temperature in the urethane extending process.

"Ratio of aromatic/aliphatic" indicates a mole ratio of the aromatic portion to the aliphatic portion of polyester resin obtained in the urethane extending process, "AV" indicates an acid value of polyester resin obtained in the urethane extending process, "Mw" indicates a weight average molecular weight of polyester resin obtained in the urethane extending process, "Tg" indicates a glass transition temperature of polyester resin obtained in the urethane extending process, and "Endothermic gradient" indicates an endothermic gradient of a glass transition temperature of polyester resin obtained in the urethane extending process.

Next, Preparation Examples 13 to 24 of an amorphous polyester-based resin latex including an amorphous polyester-based resin employed in Examples and Comparative Examples will be described.

Preparation Example 13

600 g of methylethylketone (MEK (abbreviation)), 100 g of isopropylalcohol (IPA (abbreviation)), and 500 g of amorphous polyester-based resin MPA-1 obtained in Preparation Example 1 are inserted into a 3 liter double-jacketed reaction vessel.

Then, the amorphous polyester-based resin MPA-1 obtained in Preparation Example 1 was dissolved in a mixed solvent of methylethylketone and isopropylalcohol while the reaction vessel was agitated under a condition of a temperature of about 30° C. by using a half-moon impeller.

Next, 30 g of 5% aqueous ammonia solution was slowly added into the reaction vessel, and 1,500 g of water was added thereinto at a speed of 20 g/min while the reaction vessel was agitated, to thereby form an emulsion.

Thereafter, the mixed solvent of methylethylketone and isopropylalcohol was removed from the emulsion by using a vacuum distillation method until the amorphous polyester-based resin MPA-1 has a concentration of 20 wt %, to thereby obtaining the amorphous polyester-based resin latex LMPA-1.

Preparation Examples 14 to 24

In Preparation Examples 14 to 24, amorphous polyester-based resin latexes LMPA-2 to LMPA-12 were respectively obtained by using the amorphous polyester-based resins MPA-2 to MPA-12 obtained in Preparation Examples 2 to 12, by adjusting the environment to be the same as that of Preparation Example 13.

Hereinafter, Preparation Examples 25 to 30 of the crystalline polyester resin was employed in Examples and Comparative Examples will be described.

Preparation Example 25

198.8 g of 1,9-nonanediol (made by Wako Pure Chemical Industries, Ltd), 250.8 g of dodecanedioic acid (made by Wako Pure Chemical Industries, Ltd), and 0.45 g of paratoluenesulfonic acid.1 hydrate (PTSA (abbreviation), made by Wako Pure Chemical Industries, Ltd) were inserted into a 500 ml separable flask.

Then, nitrogen was introduced into the flask, and a mixture of 1,9-nonanediol, dodecanedioic acid, and paratoluenesulfonic acid.1hydrate was heated to a temperature 80° C. to be dissolved while the flask was agitated by the agitator Next, the mixed solution in the flask was heated to a temperature of 97° C. while the flask is agitated.

Thereafter, an inside of the flask was evacuated to 10 mPa·s or less, and a dehydro-condensation reaction was performed between 1,9-nonanediol and dodecanedioic acid in the temperature of 97° C. for 45 hours, thereby forming a crystalline polyester resin C-1.

This crystalline polyester resin C-1 has a weight average molecular weight of 6,000 and a content rate of the weight average molecular weight of 1,000 or less, which was 7.2%.

Further, the melting point (endothermic peak temperature) of the differential scanning calorimetry was 70.1° C. In the differential scanning calorimetry curve, a difference between the endothermic start temperature and the endothermic peak temperature was 4.3° C., when the temperature was increased, and the endothermic amount in the melting was 3.4 W/g.

In addition, the acid value was 9.20 mg KOH/g, and a sulfur content was 186.62 ppm.

Preparation Examples 26 to 30

In Preparation Examples 26 to 30, crystalline polyester resins C-2 to C-6 were respectively obtained by adjusting environments to be the same as those of Preparation Example 25 except for varying preparation conditions as shown in Table 2.

Table 2 shows preparation conditions and properties of the crystalline polyester resin C-1 to C-6 obtained in Preparation Examples 25 to 30.

TABLE 2

| | | PE25 | PE26 | PE27 | PE28 | PE29 | PE30 |
|---|---|---|---|---|---|---|---|
| Composition | 1.9-ND (g) | 198.8 | 198.8 | 198.8 | 198.8 | 184.4 | 219 |
| | DDA (g) | 250.8 | 242.2 | 250.8 | 250.8 | 265 | 230 |
| | PTSA (g) | 0.45 | 0.45 | — | — | 0.45 | 0.045 |
| | Nf2NH (g) | — | — | 0.16 | — | — | — |
| | TBT (g) | — | — | — | 0.1 | — | — |
| Reaction condition | Reaction temperature( ° C.) | 97 | 97 | 97 | 180 | 97 | 97 |
| | Reaction time (hr) | 5 | 8 | 4 | 6 | 10 | 45 |
| molecular weight data | Mw | 6,000 | 13,000 | 5,800 | 5,800 | 21,000 | 3,700 |
| | Content rate of 1000 or less (%) | 7.2 | 3.5 | 7.6 | 10.4 | 2.8 | 19.3 |
| DSC data | Endothermic amount (W/g) | 3.4 | 3.4 | 3.4 | 3.4 | 3.5 | 2.9 |
| | Endothermic peak temperature (° C.) | 70.1 | 71.6 | 69.8 | 70.2 | 73.5 | 65.8 |
| | Endothermic start temperature (° C.) | 65.8 | 67.9 | 65.6 | 63.2 | 70.2 | 60.5 |
| | Endothermic peak - Endothermic start (° C.) | 4.3 | 3.7 | 4.2 | 7.0 | 3.2 | 5.3 |
| | AV (mgKOH/g) | 9.2 | 5.1 | 9.3 | 9.9 | 9.04 | 9.72 |
| Quantitative data | S (ppm) | 186.62 | 190.26 | 19.64 | — | 186.70 | 18.69 |
| | F (ppm) | — | — | 209.41 | — | — | — |

In Table 2, "1.9-ND" indicates an input of 1,9-nonanediol, "DDA" indicates an input of dodecanedioic acid, "PTSA" indicates an input of paratoluenesulfonic acid.1hydrate, "Nf2NH" indicates an input of bis(1,1,2,2,3,3,4,4,4-nonafluoro-1-butan sulfonyl)imide, and "TBT" indicates an input of tetra-n-butoxy titanium.

In Table 2, "Mw" indicates the weight average molecular weight, and "Content rate of 1,000 or less" indicates a connect rate of the weight average molecular weight of 1,000 Daltons or less.

"Endothermic peak-endothermic start" indicates a difference between the endothermic start temperature and the endothermic peak temperature when the temperature is increased.

"AV" indicates the acid value, "S" indicates the content of elemental sulfur, and "F" indicates the content of elemental fluorine.

Next, Preparation Examples 31 to 36 of a crystalline polyester resin latex including a crystalline polyester resin employed in Examples and Comparative Examples will be described.

Preparation Example 31

400 g of crystalline polyester resin C-1, 300 g of methylethylketone (MEK (abbreviation)), and 100 g of isopropylalcohol (IPA (abbreviation)) are inserted into a 3 liter double-jacketed reaction vessel.

Then, the crystalline polyester resin C-1 was dissolved in a mixed solvent of methylethylketone and isopropylalcohol while the reaction vessel was agitated under a condition of a temperature of about 30° C. by using a half-moon impeller Next, 30 g of 5% aqueous ammonia solution was slowly added into the reaction vessel, and 2,500 g of water was added thereinto at a speed of 20 g/min while the reaction vessel was agitated, to thereby form an emulsion.

Thereafter, the mixed solvent of methylethylketone and isopropylalcohol was removed from the emulsion by using a vacuum distillation method until the crystalline polyester resin C-1 has a concentration of 20 wt %, to thereby obtaining the crystalline polyester resin latex LC-1.

Preparation Examples 32 to 36

In Preparation Examples 32 to 36, crystalline polyester resin latexes LC-2 to LC-6 were respectively obtained by using the crystalline polyester resins C-2 to C-6 obtained in Preparation Examples 26 to 30, by adjusting the environment to be the same as that of Preparation Example 31.

Hereinafter, Preparation Example 37 of a colorant dispersion liquid employed in Examples and Comparative Examples will be described.

Preparation Example 37

60 g of cyan pigment (PB 15:3(C.I. Number)) and 10 g of anionic reactive surfactant (HS-10(tradename), made by (DKS Co. Ltd.) were put into a milling bath, and 400 g of glass bead having a diameter which was in a range of 0.8 to 1 mm are also added thereinto.

Next, a milling operation was performed in the milling bath, thereby obtaining a colorant dispersion liquid.

Hereinafter, Preparation Example 38 of a releasing agent dispersion liquid including a releasing agent employed in Examples and Comparative Examples will be described.

Preparation Example 38

270 g of paraffin wax (HNP-9(tradename), made by Japan Seiro Co., Ltd, 2.7 g of anionic surfactant (Dowfax2A 1(tradename), made by Dow Chemical Co., Ltd), and 400 g of ion-exchange water were inserted into the reaction vessel.

Thereafter, an inside of the reaction vessel was heated to a temperature of 110° C., and was dispersed by using a homogenizer (ULTRA TURRAX T50 (trade name), made by IKA Co.), and then was dispersed by using a high-pressure homogenier (NanoVater NVL-ES008 (tradename), made by Yoshida Kikai Co.), thereby obtaining a releasing agent dispersion liquid.

Hereinafter, a preparing method of a toner for developing an electrostatic charge image in Examples and Comparative Examples will be described.

Example 1

1,600 g of amorphous polyester-based resin latex LMPA-1, 100 g of crystalline polyester resin latex LC-1, and 560 g of deionized water were inserted into a 3-liter reaction vessel.

Then, 70 g of the colorant dispersion liquid obtained in Preparation Example 37 and 80 g of the releasing agent dispersion liquid obtained in Preparation Example 38 were inserted into the reaction vessel, and 30 g of nitric acid having a concentration of 0.3 N and 25 g of polysilicate iron PSI-100 (made by Suido kiko Kaisha, Ltd.) were added thereto while the reaction vessel was agitated.

Thereafter, a mixed solution inside the flask was heated to a temperature of 50° C. at a speed of 1° C./min while the reaction vessel was agitated by using a homogenizer (ULTRA TURRAX T50 (trade name), made by IKA Co.), and was also heated at a speed of 0.03° C./min until an amorphous polyester-based resin MPA-1, a crystalline polyester resin C-1, a colorant, and a releasing agent were aggregated to obtain primary aggregated particles having a predetermined volume average particle diameter. As a result, primary aggregated particles having a volume average particle diameter of 5.1 μm were formed.

Checking that the primary aggregated particles have the predetermined volume average particle diameter was performed by taking some of the mixed solution from the reaction vessel and analyzing the primary aggregated particles included in the solution.

Then, while the reaction vessel was agitated, 300 g of amorphous polyester-based resin latex LMPA-1 was added into the reaction vessel to aggregate the primary aggregated particles and the amorphous polyester-based resin MPA-1, and coating layers formed of the amorphous polyester-based resin MPA-1 were disposed on external surfaces of the primary aggregated particles, thereby obtaining coated aggregated particles.

Thereafter, an aqueous sodium hydroxide solution having a concentration of 0.1 N was added into the reaction vessel to adjust pH of the mixed solution in the reaction vessel to 9.5.

After 20 minutes, the mixed solution in the reaction vessel was heated to a temperature of 85° C., and the oated aggregated particles were fused and united, thereby obtaining toner particles including coating layers on external surfaces thereof.

Next, the mixed solution in the reaction vessel was cooled to a temperature of 28° C. or less and was filtered to obtain the toner particles, and then was dried to obtain a toner 1 for developing an electrostatic charge image.

The obtained toner 1 toner for developing an electrostatic charge image had a volume average particle diameter of 5.7 μm, an abundance of particles having a diameter 3 μm or less which was 2.2% by number, an abundance of particles having a diameter 1 μm or less which was 1.1% by number, and an abundance ratio of the particles having the diameter of 3 μm or less to the particles having the diameter of 1 μm or less which was 2.00.

Further, a content of elemental iron was 2212.4 ppm, a content of elemental silicon was 2212.4 ppm, and a content of elemental sulfur was 1206.0 ppm.

An acid value thereof was 9.1 mg KOH/g.

In addition, a thickness of the coating layers was 0.3 μm.

In the obtained toner 1 for developing an electrostatic charge image, a fixing temperature was 120° C., and the fixing temperature after long-term preservation was 125° C.

As a result, a difference between the fixing temperature in the preparation and the fixing temperature after long-term preservation was 5° C.

The preservation evaluation was ○, and the electrification evaluation was ○.

Example 2-12 and Comparative Example 1-7

In Examples 2 to 12 and Comparative Examples 1 to 7, toners 2 to 19 for developing an electrostatic charge image were obtained by adjusting environments to be the same as those of Preparation Example 1 except for varying preparation conditions as shown in Table 3.

However, in Examples 2 to 12 and Comparative Examples 1 to 7, a volume average particle diameter of the primary aggregated particles was in a range of 4 to 5 μm.

Further, pH of the mixed solution in the fusing and coalescing reaction when the toner particles were formed was in a range of 7.5 to 9.0, a temperature of the fusing and coalescing reaction was in a range of 80 to 90° C., and a time of the fusing and coalescing reaction is in a range of 3 to 5 hours.

In addition, a thickness of the coating layers was in a range of 0.2 to 1.0 μm.

Table 3 shows preparation conditions of the toners 1 to 19 for developing an electrostatic charge image in Examples 1 to 12 and Comparative Examples 1 to 7, and Table 4 shows properties of the toners 1 to 19 for developing an electrostatic charge image.

TABLE 3

| | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|
| | Toner No. | | | | | | | | | | | |
| | Toner 1 | Toner 2 | Toner 3 | Toner 4 | Toner 5 | Toner 6 | Toner 7 | Toner 8 | Toner 9 | Toner 10 | Toner 11 | Toner 12 |
| Amo | MPA-1 | MPA-2 | MPA-3 | MPA-4 | MPA-5 | MPA-6 | MPA-7 | MPA-8 | MPA-1 | MPA-1 | MPA-1 | MPA-1 |
| Cry | C-1 | C-1 | C-1 | C-1 | C-1 | C-1 | C-1 | C-1 | C-1 | C-1 | C-2 | C-3 |
| Shell material | MPA-1 | MPA-2 | MPA-3 | MPA-4 | MPA-5 | MPA-6 | MPA-7 | MPA-8 | MPA-1 | MPA-1 | MPA-1 | MPA-1 |
| PSI | PSI-100 | PSI-100 | PSI-100 | PSI-100 | PSI-100 | PSI-100 | PSI-100 | PSI-100 | PSI-100 | PSI-100 | PSI-100 | PSI-100 |
| Amo (g) | 600 | 600 | 600 | 600 | 600 | 600 | 600 | 600 | 600 | 600 | 600 | 600 |
| Cry (g) | 100 | 100 | 100 | 100 | 100 | 100 | 100 | 100 | 100 | 100 | 100 | 100 |

TABLE 3-continued

| | | | | | | | | | | | | |
|---|---|---|---|---|---|---|---|---|---|---|---|---|
| Shell material (g) | 300 | 300 | 300 | 300 | 300 | 300 | 300 | 300 | 300 | 300 | 300 | 300 |
| pig dispersion (g) | 70 | 70 | 70 | 70 | 70 | 70 | 70 | 70 | 70 | 70 | 70 | 70 |
| WAX dispersion (g) | 80 | 80 | 80 | 80 | 80 | 80 | 80 | 80 | 80 | 80 | 80 | 80 |
| PSI (g) | 25 | 25 | 25 | 25 | 25 | 25 | 25 | 25 | 50 | 13 | 25 | 25 |

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| | | | | Toner No. | | | |
| | Toner 13 | Toner 14 | Toner 15 | Toner 16 | Toner 17 | Toner 18 | Toner 19 |
| Amo | MPA-9 | MPA-10 | MPA-11 | MPA-12 | MPA-1 | MPA-1 | MPA-1 |
| Cry | C-1 | C-1 | C-1 | C-1 | C-4 | C-5 | C-6 |
| Shell material | MPA-8 | MPA-9 | MPA-10 | MPA-11 | MPA-1 | MPA-1 | MPA-1 |
| PSI | PSI-100 | PSI-100 | PSI-100 | PSI-100 | PSI-100 | PSI-100 | PSI-100 |
| Amo (g) | 600 | 600 | 600 | 600 | 600 | 600 | 600 |
| Cry (g) | 100 | 100 | 100 | 100 | 100 | 100 | 100 |
| Shell material (g) | 300 | 300 | 300 | 300 | 300 | 300 | 300 |
| pig dispersion (g) | 70 | 70 | 70 | 70 | 70 | 70 | 70 |
| WAX dispersion (g) | 80 | 80 | 80 | 80 | 80 | 80 | 80 |
| PSI (g) | 25 | 50 | 15 | 25 | 25 | 25 | 25 |

In Table 3, at an upper side, "Amo" indicates types of the amorphous polyester-based resin employed to form the primary aggregated particles, "Cry" indicates types of the crystalline polyester resins employed to form the primary aggregated particles, "shell material" indicates types of the amorphous polyester-based resin employed to form the coating layers, and "PSI" indicates types of the flocculant employed to form the primary aggregated particles.

Further, at a lower side, "Amo" indicates an amount of the amorphous polyester-based resin latex employed to form the primary aggregated particles, "Cry" indicates an amount of the crystalline polyester resin latex employed to form the primary aggregated particles, "shell material" indicates an amount of the amorphous polyester-based resin latex employed to form the coating layers, "pig dispersion" indicates an amount of the colorant dispersion liquid employed to form the primary aggregated particles, "WAX dispersion" indicates an amount of the releasing agent dispersion liquid employed to form the primary aggregated particles, and "PSI" indicates an amount of the flocculant employed to form the primary aggregated particles.

TABLE 4

| | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|
| | | | | | | Toner No. | | | | | | |
| | Toner 1 | Toner 2 | Toner 3 | Toner 4 | Toner 5 | Toner 6 | Toner 7 | Toner 8 | Toner 9 | Toner 10 | Toner 11 | Toner 12 |
| Dv50 [μm] | 5.7 | 5.2 | 6.1 | 6.2 | 6.4 | 6.4 | 5.9 | 5.8 | 7.8 | 3.9 | 5.6 | 5.9 |
| 3μ↓ | 2.2 | 2.2 | 2.1 | 1.9 | 1.7 | 1.8 | 2.1 | 2.1 | 1.3 | 2.9 | 2.4 | 2.1 |
| 1μ↓ | 1.1 | 1 | 0.9 | 0.9 | 0.8 | 0.8 | 1 | 0.9 | 0.6 | 1.4 | 1.1 | 1 |
| 3μ↓/1μ↓ | 2.00 | 2.20 | 2.33 | 2.11 | 2.13 | 2.25 | 2.10 | 2.33 | 2.17 | 2.07 | 2.18 | 2.10 |
| Fe [ppm] | 2212.4 | 2212.4 | 2212.4 | 2212.4 | 2212.4 | 2212.4 | 2212.4 | 2212.4 | 7743.4 | 1150.4 | 2212.4 | 2212.4 |
| Si [ppm] | 2212.4 | 2212.4 | 2212.4 | 2212.4 | 2212.4 | 2212.4 | 2212.4 | 2212.4 | 3971.7 | 1150.4 | 2212.4 | 2212.4 |
| S [ppm] | 1206.0 | 1206.0 | 1206.0 | 2058.9 | 2598.6 | 677.6 | 1316.1 | 1647.4 | 1482.5 | 1152.9 | 1206.3 | 1191.2 |
| F [ppm] | — | — | — | — | — | — | — | — | 8 | — | — | 18.5 |
| Acid value [mgKOH/g] | 9.1 | 9.1 | 9.1 | 8.6 | 9.1 | 6.9 | 15.2 | 9.1 | 9.1 | 9.1 | 8.7 | 8.3 |
| Fixing temperature (° C.) | 120 | 120 | 120 | 120 | 125 | 125 | 120 | 120 | 130 | 120 | 120 | 120 |
| Fixing temperature after long-term preservation (° C.) | 125 | 125 | 125 | 125 | 130 | 130 | 125 | 120 | 130 | 125 | 125 | 125 |
| Fixing temperature difference (° C.) | 5 | 5 | 5 | 5 | 5 | 5 | 5 | 0 | 0 | 5 | 5 | 5 |
| Preservation | ○ | ○ | ○ | ○ | ○ | ○ | ○ | ○ | ○ | ○ | ○ | ○ |
| Electrification | ○ | ○ | ○ | ○ | ○ | ○ | ○ | ○ | ○ | ○ | ○ | ○ |

TABLE 4-continued

| | Comparative Example 1 | Comparative Example 2 | Comparative Example 3 | Comparative Example 4 Toner No. | Comparative Example 5 | Comparative Example 6 | Comparative Example 7 |
|---|---|---|---|---|---|---|---|
| | Toner 13 | Toner 14 | Toner 15 | Toner 16 | Toner 17 | Toner 18 | Toner 19 |
| Dv50 [μm] | 6.4 | 8.7 | 4.5 | 5.9 | 5.7 | 5.4 | 5.3 |
| 3μ↓ | 1.7 | 0.9 | 4.5 | 2.9 | 2.2 | 2.8 | 2.5 |
| 1μ↓ | 0.8 | 0.3 | 3.7 | 1.2 | 1 | 1.4 | 1.1 |
| 3μ↓/1μ↓ | 2.13 | 3.00 | 1.22 | 2.42 | 2.20 | 2.00 | 2.27 |
| Fe [ppm] | 2212.4 | 7743.4 | 1327.4 | 2212.4 | 2212.4 | 2212.4 | 2212.4 |
| Si [ppm] | 2212.4 | 7743.4 | 1327.4 | 2212.4 | 2212.4 | 2212.4 | 2212.4 |
| S [ppm] | 1299.6 | 5297.0 | 396.6 | 110.6 | 1078.7 | 1206.0 | 1191.1 |
| F [ppm] | — | — | — | — | — | — | — |
| Acid value [mgKOH/g] | 25.3 | 9.1 | 8.5 | 7.8 | 1.2 | 1.2 | 1.2 |
| Fixing temperature (° C.) | 130 | 145 | 115 | 135 | 120 | 135 | 115 |
| Fixing temperature after long-term preservation (° C.) | 130 | 155 | 115 | 140 | 140 | 140 | 115 |
| Fixing temperature difference (° C.) | 0 | 10 | 0 | 5 | 20 | 5 | 0 |
| Preservation | ○ | ○ | X | ○ | ○ | ○ | X |
| Electrification | X | ○ | ○ | ○ | ○ | ○ | ○ |

In Table 4, "Dv50" indicates the volume average particle diameter, "3μ↓" indicates the abundance of the particles having the diameter of 3 μm or less, "1μ↓" indicates the abundance of the particles having the diameter of 1 μm or less, and "3μ↓/1μ↓" indicates the abundance ratio of the particles having the diameter of 3 μm or less to the particles having the diameter of 1 μm or less.

Further, "Fe" indicates the content of elemental iron, "Si" indicates the content of elemental silicon, "S" indicates the content of elemental sulfur, and "F" indicates the content of elemental fluorine.

In addition, "fixing temperature difference" indicates the difference between the fixing temperature in the preparation and the fixing temperature after long-term preservation.

As shown in Table 4, in Examples 1 to 12, the fixing temperature of all the toners 1 to 12 for developing an electrostatic charge image is equal to or lower than 130° C., and the low temperature fixedness thereof is excellent.

Further, in all cases, the fixing temperature after long-term preservation is equal to or lower than 130° C., the difference between the fixing temperature in the preparation and the fixing temperature after long-term preservation is equal to or lower than 5° C., and the low temperature fixedness is maintained even after the long-term preservation.

In Examples 1 to 12, in all the toners 1 to 12 for developing an electrostatic charge image, the preservation evaluation is ○, indicating that the preservation thereof is excellent.

In addition, in Examples 1 to 12, in all the toners 1 to 12 for developing an electrostatic charge image, the electrification evaluation is ○, indicating that appropriate electrification for being used as toners is obtained.

However, in Comparative Example 2, a toner 14 for developing an electrostatic charge image has a fixing temperature of 145° C., which goes beyond 130° C., thereby deteriorating the low temperature fixedness.

Further, the fixing temperature after long-term preservation is increased by 10° C. compared with the fixing temperature in the preparation and reaches 155° C., thereby deteriorating low temperature fixedness after the long-term preservation.

This may be because the content of elemental sulfur in the toner 14 for developing an electrostatic charge image is 5297.0 ppm, which goes beyond 3,000 ppm.

In addition, in Comparative Example 4, a toner 16 for developing an electrostatic charge image has a fixing temperature of 135° C., which goes beyond 130° C., thereby deteriorating the low temperature fixedness.

This may be because (1) the content of elemental sulfur in the toner 16 for developing an electrostatic charge image is 110.6 ppm, which is lower than 500 ppm, (2) the mole ratio of the aromatic portion to the aliphatic portion in the amorphous polyester-based resin MPA-12 employed to form the primary aggregated particles is 5.9, which goes beyond 5.8, and (3) an endothermic gradient of the glass transition temperature in the amorphous polyester-based resin MPA-12 employed to form the primary aggregated particles is 0.09 W/g·° C. which is lower than 0.1 W/g·° C.

Similarly, in Comparative Example 6, a toner 18 for developing an electrostatic charge image has a fixing temperature of 135° C., which goes beyond 130° C., thereby deteriorating the low temperature fixedness.

This may be because the weight average molecular weight of the crystalline polyester resin C-5 employed to form the primary aggregated particles is 21,000 Daltons, which goes beyond 15,000 Daltons.

In addition, in Comparative Example 5, a toner 17 for developing an electrostatic charge image has a fixing temperature of 120° C., which is lower than 130° C., and thus the low temperature fixedness is excellent at the beginning of the preparation.

However, the fixing temperature after long-term preservation is increased by 20° C., and reaches 140° C., thereby significantly deteriorating the low temperature fixedness.

This may be because (1) the difference between the endothermic start temperature and the endothermic peak temperature in the crystalline polyester resin C-4 employed to form the primary aggregated particles when the temperature is increased is 7.0° C., which goes beyond 5° C., (2) the crystalline polyester resin C-4 employed to form the primary aggregated particles does not include elemental fluorine and elemental sulfur derived from the catalyst, and (3) the content rate of the weight average molecular weight of 1,000 Daltons or less in the crystalline polyester resin C-4 employed to form the primary aggregated particles is 10.4, which goes beyond 10.0%.

In addition, in Comparative Example 3, in a toner 15 for developing an electrostatic charge image, the preservation evaluation is x, indicating that the preservation is deteriorated.

This may be because the content of elemental sulfur in the toner 15 for developing an electrostatic charge image is 396.6 ppm, which is lower than 500 ppm.

Further, in the toner 15 for developing an electrostatic charge image, the abundance ratio of the particles having the diameter of 3 μm or less to the particles having the diameter of 1 μm or less is 1.22, which is lower than 2.0. This may be another factor, which causes the preservation to deteriorating.

In Comparative Example 7, in a toner 19 for developing an electrostatic charge image, the preservation evaluation is x, indicating that the preservation is deteriorated.

This may be because (1) the weight average molecular weight of the crystalline polyester resin C-6 employed to form the primary aggregated particles is 3,700 Daltons, which is smaller than 5,000 Daltons, (2) the difference between the endothermic start temperature and the endothermic peak temperature in the crystalline polyester resin C-6 employed to form the primary aggregated particles when the temperature is increased is 5.3° C., which goes beyond 5° C., (3) the content rate of the weight average molecular weight of 1,000 Daltons or less in the crystalline polyester resin C-6 employed to form the primary aggregated particles is 19.3, which goes beyond 10.0%.

In Comparative Example 1, in a toner 13 for developing an electrostatic charge image, the electrification evaluation is x, indicating that appropriate electrification for being used as a toner is not obtained.

This may be because an acid value of the toner 13 for developing an electrostatic charge image is 25.3 mg KOH/g, which goes beyond 25 mg KOH/g.

Meanwhile, in each Examples described above, the amorphous polyester-based resin employed to form the primary aggregated particles is the same as the amorphous polyester-based resin employed to form the coating layers.

However, in the case of including the aforementioned characteristics (1) to (3) of the amorphous polyester-based resin, even when the amorphous polyester-based resin employed to form the primary aggregated particles is different from the amorphous polyester-based resin employed to form the coating layers, it is possible to obtain a toner for developing an electrostatic charge image, including the same characteristics as those in Examples.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A toner for developing an electrostatic charge image, the toner comprising:

elemental iron, wherein a content of the elemental iron is in a range of $1.0\times10^3$ to $1.0\times10^4$ ppm, based on a total weight of the toner;

elemental silicon, wherein a content of the elemental silicon is in a range of $1.0\times10^3$ to $5.0\times10^3$ ppm, based on a total weight of the toner;

elemental sulfur, wherein a content of the elemental sulfur is in a range of 500 to 3,000 ppm, based on a total weight of the toner;

optionally elemental fluorine, wherein a content of the elemental fluorine, if present, is in a range of $1.0\times10^3$ to $1.0\times10^4$ ppm; and a binder resin comprising an amorphous polyester resin, wherein (1) a mole ratio of an aromatic portion of the amorphous polyester resin to an aliphatic portion amorphous polyester resin is in a range of 4.5 to 5.8, (2) a glass transition temperature of the amorphous polyester resin, when measured by a differential scanning calorimetry, is in a range of 50 to 70° C., and (3) an endothermic gradient in the glass transition temperature of the amorphous polyester resin is in a range of 0.1 to 1.0 W/g° C., and a crystalline polyester resin comprising elemental sulfur and elemental fluorine, wherein (a) an endotherm in the melting of the crystalline polyester resin, when measured by the differential scanning calorimetry, is in a range of 2.0 to 10.0 W/g, (b) a weight average molecular weight of the crystalline polyester resin is in a range of 5,000 to 15,000 Daltons, (c) a difference between an endothermic start temperature and an endothermic peak temperature of the crystalline polyester is in range of 3 to 5° C. when the temperature of the crystalline polyester resin is increased in the differential scanning calorimetry curve when determined by the differential scanning calorimetry, (d) a content of the crystalline polyester resin having a weight average molecular weight of 1,000 Daltons or less which is in a range of 1 to less than 10%, based on a total content of the crystalline polyester resin.

2. The toner of claim 1, further comprising a coating layer disposed on an external surface of the toner, wherein the coating layer comprises the amorphous polyester resin.

3. The toner of claim 2, wherein a thickness of the coating layer is in a range of 0.2 to 1.0 μm.

4. The toner of claim 1, wherein an acid value of the toner is in a range of 3 to 25 mg KOH/g.

5. The toner of claim 1, wherein a volume average particle diameter of the toner is in a range of 3 to 9 μm, a content of particles having number average particle size of 3 μm or less is equal to or less than 3%, based on a total content of the toner, and a content of particles the number average particle size of 3 μm or less to a number average particle size of 1 μm or less is in a range of 2.0 to 4.0, based on a total content of the toner.

* * * * *